US007174867B2

(12) United States Patent
Gokan et al.

(10) Patent No.: US 7,174,867 B2
(45) Date of Patent: Feb. 13, 2007

(54) AIR-COOLED INTERNAL COMBUSTION ENGINE

(75) Inventors: Yoshitsugu Gokan, Saitama (JP); Masazumi Naito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 158 days.

(21) Appl. No.: 10/989,537

(22) Filed: Nov. 16, 2004

(65) Prior Publication Data

US 2005/0115530 A1 Jun. 2, 2005

(30) Foreign Application Priority Data

Nov. 25, 2003 (JP) ..... 2003-394799
Jun. 18, 2004 (JP) ..... 2004-181273
Sep. 16, 2004 (JP) ..... 2004-270474

(51) Int. Cl.
*F01L 1/02* (2006.01)

(52) U.S. Cl. ..... 123/90.31; 123/90.15; 123/90.38

(58) Field of Classification Search ..... 123/90.15, 123/90.16, 90.17, 90.18, 90.27, 90.31, 193.5, 123/193.3, 90.38
See application file for complete search history.

(56) References Cited

U.S. PATENT DOCUMENTS 5,743,228 A * 4/1998 Takahashi ..... 123/195 P
6,652,400 B2 * 11/2003 Duesmann et al. ..... 474/86

FOREIGN PATENT DOCUMENTS

JP 59070856 4/1984
JP 01178709 7/1989
JP 08296434 A * 11/1996

* cited by examiner

*Primary Examiner*—Ching Chang
(74) *Attorney, Agent, or Firm*—Carrier, Blackman & Associates, P.C.; William D. Blackman; Joseph P. Carrier

(57) ABSTRACT

An air-cooled internal combustion engine includes a cylinder block having a plurality of cylinder bores disposed in parallel to each other, a cylinder head secured to an upper portion of the cylinder block, a crankshaft, two camshafts disposed in a parallel, juxtaposed relationship to each other so as to extend perpendicularly to a forward and backward direction of a vehicle on which the engine is mounted at an upper portion of said cylinder head and positioned on front and rear sides of the engine relative to each other, and a camshaft driving mechanism for transmitting rotational driving force of the crankshaft to the camshafts. A cooling space into which wind can be introduced is formed below that one of the camshafts which is positioned on the front side of the engine. The entire cylinder head is thus cooled efficiently, including portions corresponding to the cylinders disposed at intermediate positions of the engine.

20 Claims, 15 Drawing Sheets

(C-C section)

(D-D section)

(E-E section)

(A-A section of FIG. 5(a))

(B-B section of FIG. 5(a))

(F-F section of FIG. 9(a))

PRIOR ART

PRIOR ART

PRIOR ART

PRIOR ART

AIR-COOLED INTERNAL COMBUSTION ENGINE

CROSS-REFERENCE TO RELATED APPLICATIONS

The present invention claims priority under 35 USC 119 based on Japanese patent application Nos. 2003-394799, filed on Nov. 25, 2003, 2004-181273, filed on Jun. 18, 2004, and 2004-270474 filed on Sep. 16, 2004. The subject matter of these priority documents is incorporated by reference herein.

BACKGROUND OF THE INVENTION

1. Field of the Invention

This invention relates to an internal combustion engine, and more particularly to an improved technique directed to cooling of a four-cycle air-cooled internal combustion engine for a motorcycle.

2. Description of the Background Art

Driving of two camshafts by a crankshaft in an internal combustion engine of the dual over head cam (DOHC) type is well known and is performed using a timing chain or a belt. The same timing chain or belt extends between and around sprocket wheels provided on the two camshafts such that the two camshafts are simultaneously driven at an equal speed. According to the driving system for the camshafts, the chain or belt passes through a chain chamber between cylinders disposed in parallel to each other in a cylinder element (refer to, for example, Japanese Patent No. 2,593,674 (page 1, FIG. 1)).

Further, a driving system for camshafts by a crankshaft in an air-cooled internal combustion engine of the DOHC type is known. In the known driving system, two camshafts are disposed on each of the left and right of a cylinder head, and the left and right camshafts are driven by camshaft driving apparatus disposed on the opposite left and right sides of the engine, respectively. Driving of the two camshafts on each of the left and right is performed such that one of the camshafts is driven by the crankshaft through a chain while the other camshaft is driven by the one camshaft through another chain. According to the camshaft driving mechanism, the camshaft driving apparatus are disposed on the opposite left and right sides of the engine thereby to substantially eliminate the necessity for provision of a chain chamber between the cylinders (refer to, for example, Japanese Patent Publication No. Hei 5-55686 (pages 1 to 2, FIGS. 1 and 2)).

The camshaft driving system of the invention disclosed in Japanese Patent No. 2,593,674 mentioned above is shown in FIGS. 13-*a* and 13-*b*. In the camshaft driving system, a space for a timing chain 016 for driving camshafts is defined by a cylinder wall. That is, a chain chamber 031 is provided at a central portion 030 in the longitudinal direction of a cylinder element 0E0, and the timing chain 016 is driven to circulate in the chain chamber 031. The timing chain 016 extends between a sprocket wheel 010*h* attached to a crankshaft 010 and sprocket wheels 033*c*, 034*c* of an equal diameter attached to two camshafts 033, 034, respectively, such that driving rotation of the crankshaft 010 is transmitted to the two camshafts 033, 034 through the single timing chain 016.

Incidentally, this camshaft driving system is adopted by a four-cycle water-cooled internal combustion engine. Thus, where the layout is applied to a four-cycle air-cooled internal combustion engine, the radiation area, for example, for cooling fins or the like cannot be sufficiently achieved from the available space around the cylinders positioned in the proximity of the chain chamber. Also, it is recognized that a corrective measure for handling heat radiation cannot be taken readily. Accordingly, heat cannot be radiated sufficiently from the cylinders which are positioned in the proximity of the chain chamber when compared with the cylinders which are not positioned in the proximity of the chain chamber. Therefore, an non-uniform thermal influence occurs with the cylinder section.

Additionally, the camshaft driving system of the invention disclosed in Japanese Patent Publication No. Hei 5-55686 (pages 1 to 2, FIGS. 1 and 2) mentioned hereinabove is shown in FIGS. 14-*a* and 14-*b*. In the known camshaft driving system, two camshafts 033, 034 are disposed on each of the left and right of a cylinder head 03, and driving apparatus for the camshafts 033, 034 are individually disposed on the opposite left and right sides of an engine 0E. A timing chain 016 extends between a sprocket wheel 033*c* of a large diameter attached to one of the two camshafts 033, 034 on each of the left and right and a sprocket wheel 010*h* of a crankshaft 010, and the camshaft 033 is driven by the timing chain 016. An inter camshaft driving chain 036 extends between a sprocket wheel 033*d* of a small diameter attached to the camshaft 033 and a sprocket wheel 034*d* attached to the other camshaft 034 and having a diameter equal to that of the sprocket wheel 033*d* of the small diameter, and the camshaft 034 is driven through the inter camshaft driving chain 036.

According to the camshaft driving system, the camshafts disposed two by two on the left and right of the cylinder head are driven by the camshaft driving apparatus disposed on the opposite left and right sides of the engine. Therefore, it is not necessary to provide a chain chamber for a camshaft driving chain between cylinders disposed in a juxtaposed relationship to each other. However, two series of driving apparatus for driving the camshafts are required, and the associated complication of the engine structure and increased number of parts cannot be avoided. Consequently, the cost of the engine is increased.

In such situations as described above, development of an improved structure of an air-cooled internal combustion engine is desirable. The present invention provides such an improved engine, wherein the cooling at a cylinder section is achieved efficiently by a comparatively simple alteration in structure which does not invite complication of the engine structure. Such improved engine includes a camshaft driving system wherein a camshaft driving mechanism for transmitting rotational driving force of a crankshaft to camshafts is disposed between cylinder bores of a cylinder block, and the rotational driving force of the crankshaft is transmitted to that one of the camshafts which is positioned on the rear side of a vehicle. In addition, the rotational driving force transmitted to the rear side camshaft is further transmitted to the camshaft on the front side through a driving force transmitting mechanism between the camshafts.

SUMMARY OF THE INVENTION

The present invention relates to an improved structure of an air-cooled internal combustion engine for solving the situations described above. According to the invention, there is provided an air-cooled internal combustion engine which includes a cylinder block having a plurality of cylinder bores disposed in parallel to each other, a cylinder head secured to an upper portion of the cylinder block, two camshafts disposed in a parallel, juxtaposed relationship to each other so as to extend perpendicularly to a forward and backward direction of a vehicle at an upper portion of the cylinder head and positioned on front and rear sides relative to each other. The air-cooled internal combustion engine also includes a camshaft driving mechanism for transmitting rotational driving force of a crankshaft to the camshafts, and a cooling space is formed below that one of the camshafts which is positioned on the front side. Running wind, generated by forward movement of the vehicle, is introduced into the cooling space and is subsequently channeled through the cylinder head and cylinder block.

Further, in the air-cooled internal combustion engine, the camshaft driving mechanism for transmitting the rotational driving force of the crankshaft to the camshafts includes a first camshaft driving device and a second camshaft driving device. The first camshaft driving device is disposed between the cylinder bores of the cylinder block, and transmits the rotational driving force of the crankshaft to that one of the camshafts which is on the rear side of the vehicle. The second camshaft driving device transmits the rotational driving force transmitted to the rear side camshaft further to the front side camshaft. The cooling space into which the running wind can be introduced is formed forwardly of the first camshaft driving device and below the second camshaft driving device.

Further, in the air-cooled internal combustion engine the transmission of the rotational driving force of the camshaft driving mechanism is performed using a chain. The air-cooled internal combustion engine is a four-cylinder engine having the four cylinder bores extending in parallel to each other, and the camshaft driving mechanism is disposed between the second one and the third one of the cylinder bores. Furthermore, the air-cooled internal combustion engine includes a cylinder head cover attached to the cylinder head and has a portion formed in a concave shape between the camshafts. The concave portion is open at a lower portion thereof and communicates with the cooling space through the opening.

Further, in the air-cooled internal combustion engine an inputting portion of the first camshaft driving device for the rear side camshaft is formed with a diameter greater than that of an outputting portion of the second camshaft driving device.

Further, in the air-cooled internal combustion engine a tensioner is provided in order to maintain tension of the chain of the second camshaft driving device, and the tensioner applies tension outwardly from a location between portions of the chain.

According to a first aspect of the invention, an air-cooled internal combustion engine is provided which includes a cylinder block having a plurality of cylinder bores disposed in parallel to each other, a cylinder head secured to an upper portion of the cylinder block, two camshafts disposed in a parallel, juxtaposed relationship to each other so as to extend perpendicularly to a forward and backward direction of a vehicle at an upper portion of the cylinder head and positioned on front and rear sides relative to each other, and a camshaft driving mechanism for transmitting rotational driving force of a crankshaft to the camshafts. The air-cooled internal combustion engine is configured such that a cooling space into which running wind can be introduced is formed below that one of the camshafts which is positioned on the front side. Consequently, cooling wind can be introduced efficiently to the cylinder bores (cylinders) disposed around the camshaft driving mechanism. Particularly since cylinder bore forming faces adjacent the camshaft driving mechanism are contacted by the cooling wind, the cylinder bores are cooled uniformly.

According to another aspect of the invention, the air-cooled internal combustion engine according to the invention as set forth above is configured such that the camshaft driving mechanism for transmitting the rotational driving force of the crankshaft to the camshafts includes a first camshaft driving device, disposed between the cylinder bores of the cylinder block, for transmitting the rotational driving force of the crankshaft to that one of the camshafts which is on the rear side of the vehicle. The camshaft driving mechanism includes a second camshaft driving device for transmitting the rotational driving force transmitted to the rear side camshaft further to the front side camshaft, and the cooling space into which the running wind can be introduced is formed forwardly of the first camshaft driving device and below the second camshaft driving device. As a consequence of this location, the cooling space is formed to be large in size, and the cooling wind is introduced with a high efficiency to the cylinder bores disposed around the camshaft driving mechanism.

According to another aspect of the invention, the air-cooled internal combustion engine according to the invention as set forth above is configured such that the transmission of the rotational driving force of the camshaft driving mechanism is performed using a chain. Consequently, reliable transmission of driving force can be achieved at a low cost without resulting in a complicated structure.

According to another aspect of the invention, the air-cooled internal combustion engine according to the invention as set forth above is configured such that the internal combustion engine is a four-cylinder engine having the four cylinder bores extending in parallel to each other, and the camshaft driving mechanism is disposed between the second one and the third one of the cylinder bores. Consequently, the cooling space is formed at the location between the cylinder bores disposed at intermediate positions in the engine. Cooling between these cylinder bores is difficult when compared with the cylinder bores (cylinders) which are positioned on the outermost sides. By providing a cooling space between the intermediate cylinder bores, a balanced cooling of the engine is established. As a further consequence, an increase in size of the cooling apparatus is avoided.

According to another aspect of the invention, the air-cooled internal combustion engine according to the invention as set forth above is configured such that a cylinder head cover is attached to the cylinder head and has a portion formed in a concave shape between the camshafts. The concave portion is open at a lower portion thereof and communicates with the cooling space through the opening. Consequently, by introducing the cooling wind from the cooling space in front of the cylinder block to the concave portion of the cylinder head cover, an exit and an entrance are formed for the cooling wind which passes plug mounting seat portions, and circulation of the cooling wind can be positively performed.

Further, by supplying sufficient cooling wind to the plug mounting seat portions of the intermediate cylinders, the temperatures of the plug seats and the temperatures of the wall faces of various portions are lowered. Further, correction of the balance in thermal influence between outer side cylinders and intermediate cylinders of a multi-cylinder engine is achieved.

According to another aspect of the invention, the air-cooled internal combustion engine according to the invention as set forth above is configured such that an inputting portion of the first camshaft driving device formed for the rear side camshaft is formed with a diameter greater than that of an outputting portion of the second camshaft driving device. Consequently, a power transmission mechanism between the camshafts is miniaturized, and the cooling space is readily achieved and the cooling efficiency is improved.

According to another aspect of the invention, the air-cooled internal combustion engine according to the invention as set forth above is configured such that a tensioner is provided in order to maintain tension of the chain of the second camshaft driving device, and the tensioner applies tension outwardly from a location between portions of the chain. Consequently, the tensioner does not project outwardly of the cylinder head, and therefore, the head is compact in size and the appearance of the head is improved.

Modes for carrying out the present invention are explained below by reference to an embodiment of the present invention shown in the attached drawings. The objects, characteristics and advantages of the present invention will become apparent form the detailed description of the embodiment of the invention presented below in conjunction with the attached drawings. It should be understood, however, that the detailed description of a specific example, while indicating the present embodiment of the invention, is given by way of illustration and not of limitation. Many changes and modifications may be made within the scope of the present invention without departing from the spirit thereof, and the invention includes all such modifications.

DETAILED DESCRIPTION OF THE INVENTION

Figure 1:
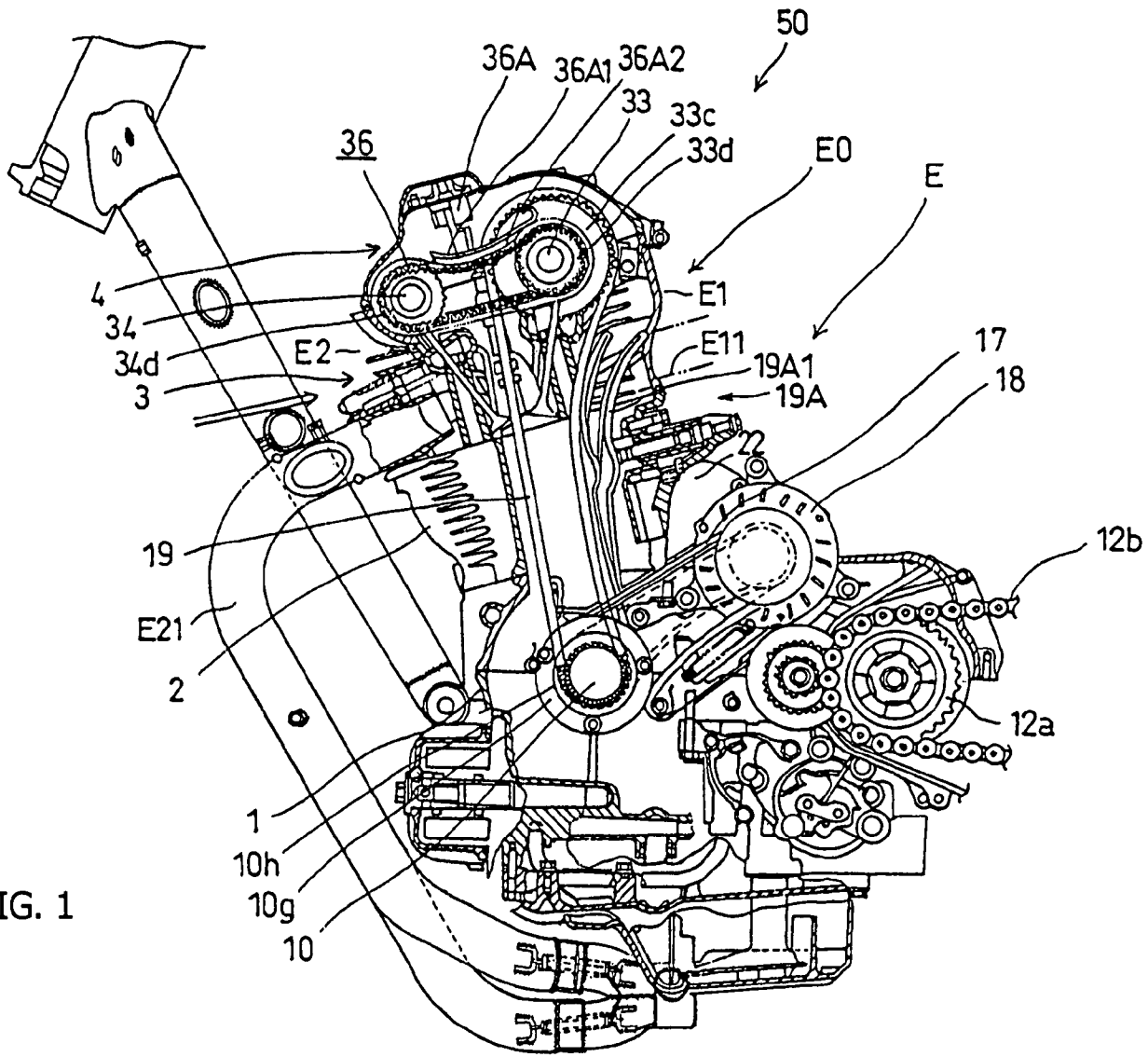
FIG. 1 is a side elevational view showing an internal combustion engine to which improvement of the present invention is applied and showing a part of a structure of a vehicle in which the engine is incorporated.

The present invention is carried out such that a camshaft driving mechanism for transmitting rotational driving force of a crankshaft 10 to camshafts 33, 34 includes a first camshaft driving mechanism or device disposed between cylinder bores 2*a* of a cylinder block 2 for transmitting the rotational driving force of the crankshaft 10 to that one of the camshafts 33 which is on the rear side of a vehicle 50. The camshaft driving mechanism includes a second camshaft driving mechanism or device for transmitting the rotational driving force transmitted to the rear side camshaft 33 further to the front side camshaft 34 According to an important aspect of the invention, a cooling space 32 is formed forwardly of the first camshaft driving device below the second camshaft driving device. Running wind, represented in the figures by open arrows, is introduced into the cooling space 32 and is subsequently channeled through the cylinder head 3 and cylinder block 2.

An embodiment of the present invention is described with reference to FIGS. 1 to 12.

A vehicle 50 in the form of a motorcycle on which an internal combustion engine E of the present embodiment is incorporated is partially shown in FIG. 1 such that only the structure around the location where the internal combustion engine E is located is seen.

The vehicle 50 has, similarly to an ordinary vehicle, a vehicle body frame structure which includes a head pipe, a front fork, a handle bar, a main frame, a seat rail, a back stay, a swing arm for supporting a rear wheel and so forth.

Referring now to FIG. 1, which provides is a side elevational view of the internal combustion engine E, it is seen that the engine E is a four-cycle parallel four-cylinder engine of the air-cooled type and adopts a twin cam mechanism of the overhead valve type (DOHC). The internal combustion engine E is disposed on vehicle 50 such that the head exhaust side E2 of a cylinder element E0 thereof is oriented in a forward traveling direction while the intake side E1 thereof is oriented in an upward direction. An intake pipe E11 extends upwards from an upper portion of the cylinder element E0, and a carburetor and an air cleaner not shown are connected to the intake pipe E11. Meanwhile, an exhaust pipe E21 extends toward the rear from the front side of the cylinder element E0 and passes below the vehicle body.

The cylinder element E0 of the engine E is placed and secured at a lower portion thereof on and to an upper portion of a crankcase 1. The cylinder element E0 includes a cylinder block 2 secured directly to the crankcase 1, a cylinder head 3 secured at a lower portion thereof to an upper portion of the cylinder block 2, and a cylinder head cover 4 secured to the cylinder head 3 and covering an upper portion of the cylinder head 3. These structural elements mentioned are joined and secured to one another and integrated by means of bolts to form the cylinder element E0.

Figure 2:
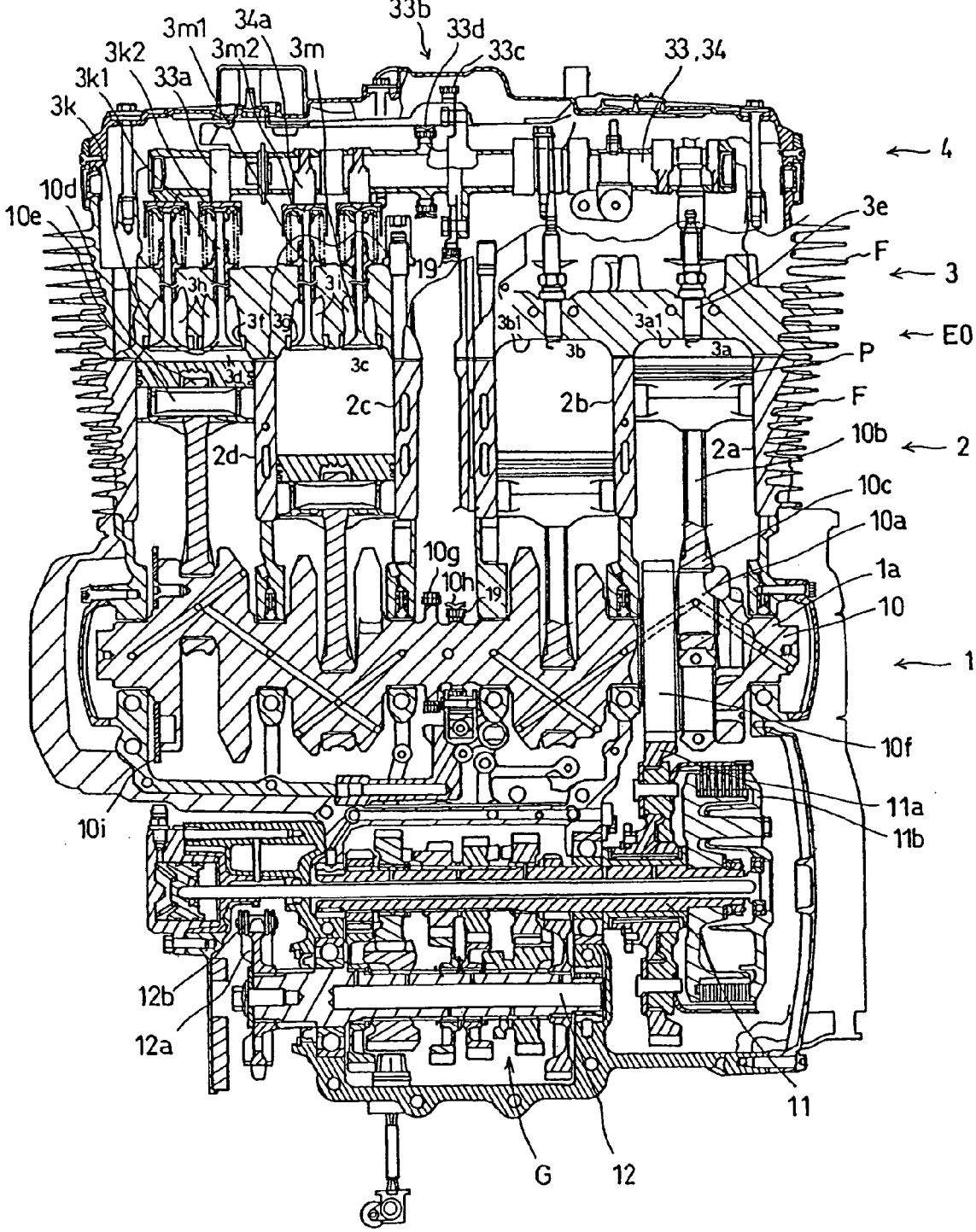
FIG. 2 is a sectional view showing a principal structural portion of the internal combustion engine of the present invention.

A crankshaft 10 is supported for rotation on the crankcase 1 through a plurality of (six) journal bearing portions 1*a* as seen in FIG. 2 (only one journal bearing portion is referenced). Further, connecting rods 10*b* are attached through larger end portions 10*c* thereof to four crank pins 10*a* of the crankshaft 10, and pistons P are individually attached to smaller end portions 10*d* of the connecting rods 10*b* through piston pins 10*e*. The pistons P are individually slidably moved back and forth in cylinder bores 2*a*–2*d* formed in the cylinder block 2. The structures of the elements described are well known in the art.

A driving gear 10*f* is attached to a right-side portion of the crankshaft 10 in FIG. 2 in the longitudinal direction of the crankshaft 10. The driving gear 10*f* is held in meshing engagement with a driven gear 11*a* loosely fitted on a main shaft 11 of a gear box so that driving force is transmitted from the driven gear 11*a* to the main shaft 11 through a clutch 11*b*. The driving force is transmitted to a countershaft 12 through selective meshing engagement of gears of a speed change gear G on the main shaft 11 and the countershaft 12. The driving force transmitted to the countershaft 12 is further transmitted from the driving sprocket wheel 12*a* to the rear wheel not shown, which is a driving wheel for traveling of the vehicle, through a driving chain 12*b*.

Figure 3:
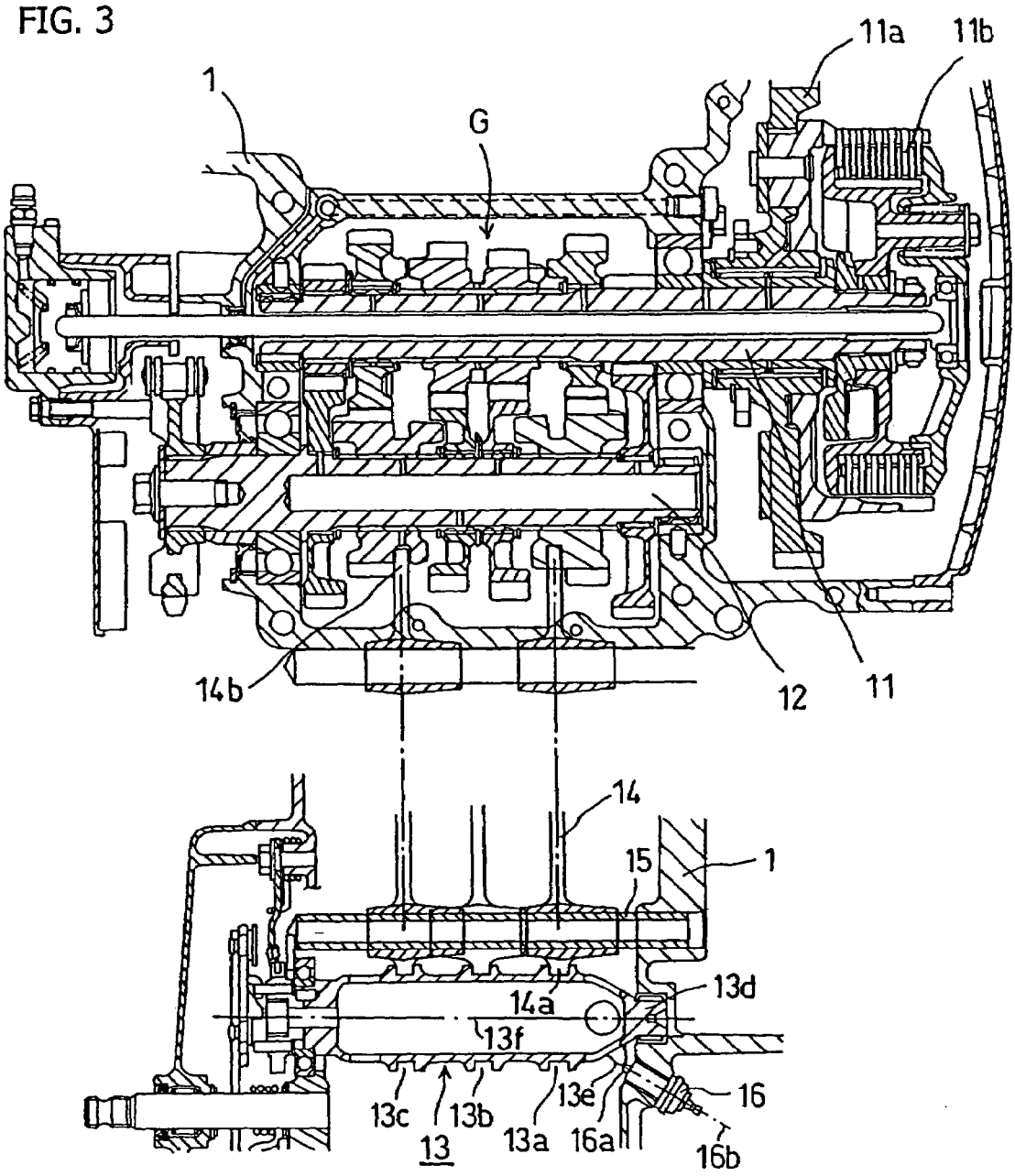
FIG. 3 is a sectional view of a portion of the principal structural portion of the internal combustion engine of the present invention showing.

The main shaft 11 and the countershaft 12 both extend in parallel to the crankshaft 10 and are supported at the opposite ends or at portions proximate to the opposite ends thereof for rotation on the crankcase 1 by means of bearings. Further, as shown in FIG. 3, a shift drum 13 is disposed in parallel to and in a neighboring relationship with the main shaft 11 and the countershaft 12. Also the shift drum 13 is supported at the opposite ends thereof for rotation on the crankcase 1 by means of bearings and intermittently rotates in an interlocking relationship with an operation of a change shift pedal (not shown).

While selective meshing of the speed change gear G is performed by intermittent rotation of the shift drum 13 based on the change shift pedal operation described above, the speed change is performed in the following manner. In particular, in each of three cam grooves 13*a*, 13*b*, 13*c* provided on an outer circumferential face of the shift drum 13, a shifter 14 is fitted at a projection 14*a* at an end thereof such that, in response to rotation of the shift drum 13, the shifter 14 is moved leftwardly or rightwardly along a shift guide shaft 15. Thereupon, the shifter 14 moves, through a bifurcated fork 14*b* at the other end thereof, a desired one of gear wheels of the speed change gear G for desired speed change.

A sensor 16 for detecting a position of the shift drum 13 corresponding to a neutral position in rotation of the shift drum 13 is provided on a structural portion of the crankcase 1 adjacent a bearing supported portion 13*d* at the right end of the shift drum 13 in the figure. The sensor 16 is disposed on the structural portion of the crankcase 1 such that a detecting portion 16*a* thereof contacts with a neutral detection projection 13*e* in rotation of the shift drum 13 on an outer circumferential portion of the shift drum 13 in the proximity of the bearing supported portion 13*d*. The disposition of the sensor 16 is such that an axial line 16*b* of the sensor 16 has an angle inclined with respect to a rotational axial line 13*f* of the shift drum 13. The inclined disposition of the sensor 16 allows for suppression of the size dimension of the internal combustion engine E in the widthwise direction to achieve a compact configuration of the engine E.

Referring back to FIG. 2, two sprocket wheels 10*g*, 10*h* having different diameters from each other are provided in parallel to each other at a central portion of the crankshaft 10 in the longitudinal direction of the cylinder block 2. The sprocket wheel 10*g* of the larger diameter drives a generator 18 through a chain 17 (refer to FIG. 1). To the generator 18, a starter motor is connected in a coaxial relationship through a one-way clutch not shown. Meanwhile, the sprocket wheel 10*h* of the smaller diameter is for driving camshafts 33, 34 through a chain 19 which is hereinafter described in detail. Further, a pulser rotor 10*i* is attached to a position closely adjacent to the left end of the crankshaft 10 in the longitudinal direction.

Figure 4:
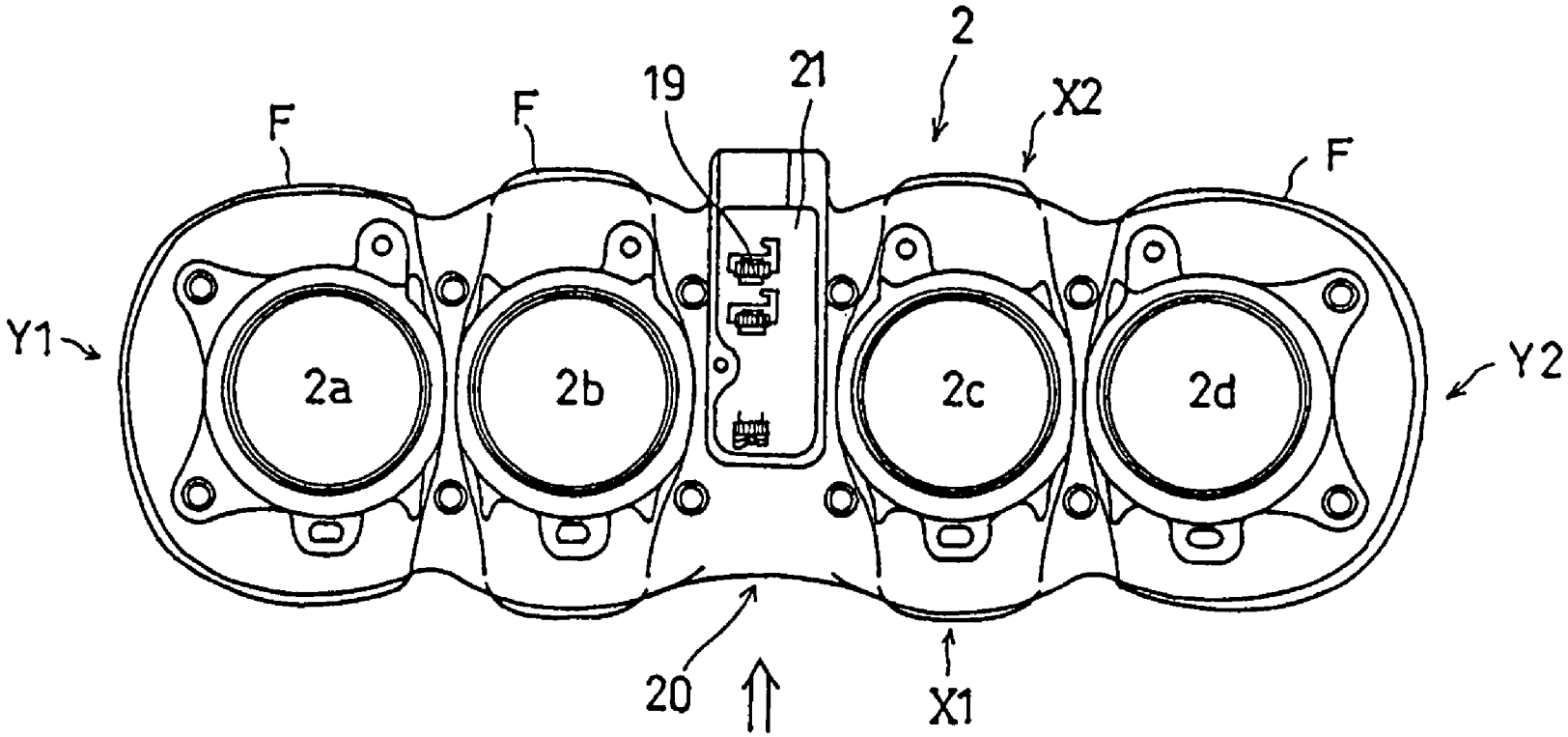
FIG. 4 is a top plan view of the cylinder block of the internal combustion engine of the present invention showing the paired, parallel arrangement of the cylinder bores about the longitudinal centerline.

The cylinder block 2 placed on and secured to an upper portion of the crankcase 1 has, as viewed in plan (top plan) as seen in FIG. 4, a substantially rectangular shape elongated in a direction perpendicular to the forward and backward direction of the vehicle 50. The four cylinder bores 2*a* to 2*d* are disposed in parallel in the cylinder block 2 as seen in FIG. 2 along the longitudinal direction. The cylinder bores 2*a* to 2*d* extend upwardly and downwardly through the cylinder block 2, and the pistons P described hereinabove are disposed, as is known in the art, for back and forth sliding movement in the cylinder bores 2*a* to 2*d* as described hereinabove.

A space section, or vacancy, 21 for allowing the chain 19 for driving the camshafts 33, 34 to pass therethrough is formed at a longitudinal central portion 20 of the cylinder block 2. The space section 21 extends upwardly and downwardly through the cylinder block 2 at a position of the cylinder block 2 displaced a little rearwardly in the widthwise direction of the cylinder block 2 of the longitudinal central portion 20, and has a substantially rectangular shape elongated in the widthwise direction as viewed in a top plan of the cylinder block 2. Accordingly, the four cylinder bores 2*a*–2*d* of the cylinder block 2 are disposed in pairs in a leftwardly and rightwardly spaced relationship. The first pair 2*a*, 2*b* are separated from the second pair 2*c*, 2*d* by the space section 21 positioned at the longitudinal central portion 20 of the cylinder block 2.

A large number of cooling fins F are provided on an outer circumferential face of the cylinder block 2 as seen with reference to FIGS. 1, 2 and others. The cooling fins F are formed from a plurality of plane forming portions disposed in a predetermined spaced relationship from each other in planes substantially parallel to a top plan shown in FIG. 4. The cooling fins F are formed as a plurality of lateral fins F extending outwardly by a predetermined length from the circumferential portions, that is, long side faces X1, X2 and short side faces Y1, Y2, of the cylinder block 2.

As shown in FIG. 4, the cooling fins F are provided on the opposite side faces of the long side faces X1, X2 and on the respective short side face Y1 or Y2 around the cylinder bores 2*a*, 2*d* positioned at the opposite ends of the cylinder block 2 in the longitudinal direction, and therefore the cooling fins are provided on more than one half of the circumference of cylinder bores 2*a* and 2*d*. In contrast, around the cylinder bores 2*b*, 2*c* adjacent the space section 21 for the chain 19 of the cylinder block 2, the cooling fins F are provided only on the opposing side faces of the long side faces X1, X2 of the cylinder block 2 and therefore are provided at most on one half of the circumference of cylinder bores 2*b* and 2*c*. It is for this reason that a sufficient cooling countermeasure cannot be taken.

Figure 5A:
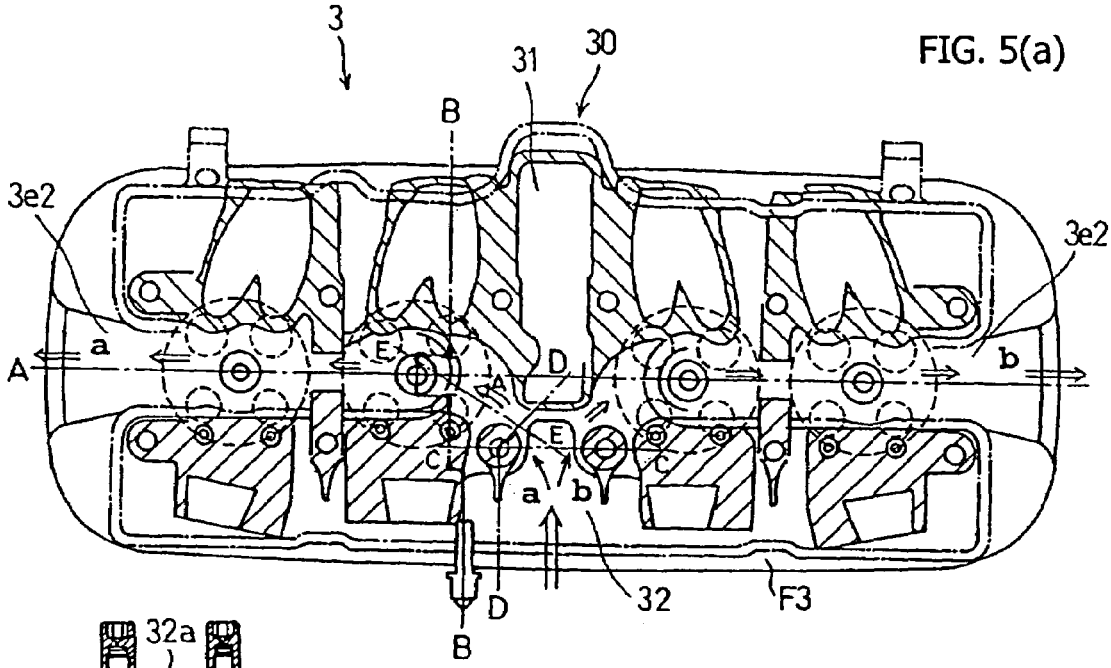
FIG. 5*a* is a top plan view of the cylinder head of the internal combustion engine of the present invention, showing the depressed portion of the cylinder head located forward of the space section of the cylinder head.

The cylinder head 3, secured to an upper portion of the cylinder block 2, has, as viewed in a plan indicated by a predetermined section shown in FIG. 5*a*, a substantially rectangular shape similar to that of the cylinder block 2. As seen in FIG. 2, and in FIG. 6 in which only a left portion of a section of the cylinder head 3 in the longitudinal direction is shown, four recesses 3*a*1 to 3*d*1 (only two left side ones 3*a*1 and 3*b*1 are shown in FIG. 6) for forming combustion chambers 3*a* to 3*d*, corresponding to the four cylinder bores 2*a* to 2*d* of the cylinder block 2, are formed at a lower portion of the cylinder head 3.

Figure 6:
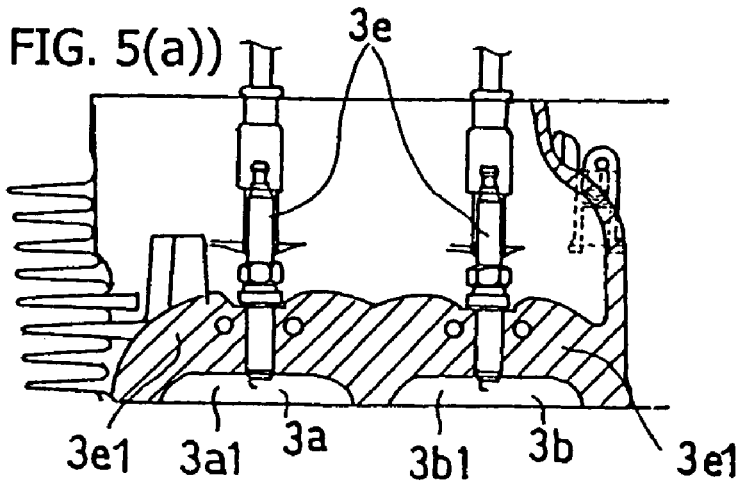
FIG. 6 is a detail sectional view of the cylinder block of the internal combustion engine of the present invention showing a section taken along line A—A of FIG. 5*a*.
Figure 7:
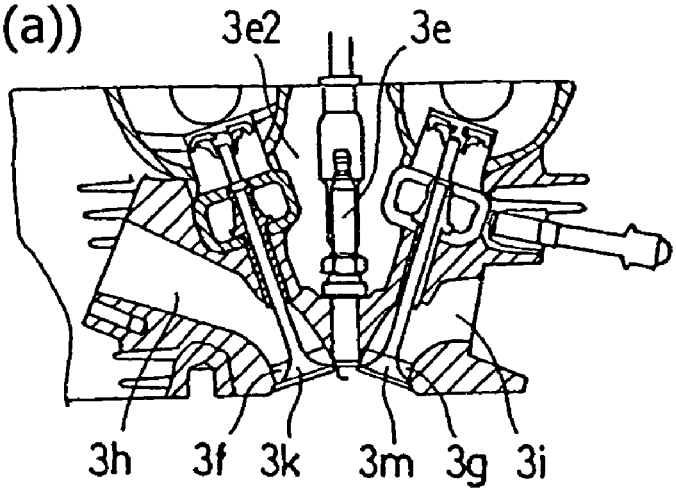
FIG. 7 is a detail sectional view of the cylinder block of the internal combustion engine of the present invention showing a section taken along line B—B of FIG. 5*a*.

As can be seen from reference to FIGS. 2, 6 and 7 (FIG. 7 showing a widthwise section of the cylinder head 3), the combustion chambers 3*a* to 3*d* formed from the recesses 3*a*1 to 3*d*1, and upper portions of the respective cylinder bores 2*a* to 2*d* of the cylinder block 2 are disposed in the cylinder head 3. Further, ignition plugs 3*e* are mounted so as to be exposed respectively to the combustion chambers. Intake and exhaust ports 3*f*, 3*g*, which open to the combustion chambers 3*a* to 3*d*, respectively, and intake and exhaust paths 3*h*, 3*i*, which communicate with the intake and exhaust ports 3*f*, 3*g*, respectively, are disposed in the cylinder head 3. Furthermore, fuel injection systems not shown mounted for the intake paths 3*h*, intake and exhaust valves 3*k*, 3*m* for opening and closing the intake and exhaust ports 3*f*, 3*g*, respectively, valve systems for operating the intake and exhaust valves 3*k*, 3*m* to open and close, and so forth are disposed in the cylinder head 3.

As seen in a top plan view along a predetermined section of the cylinder head 3 as shown in FIG. 5*a*, a space section 31 for the chain 19 is provided at a position displaced toward the rear in the widthwise direction at a longitudinal central portion 30 of the cylinder head 3 such that it extends upwardly and downwardly through the cylinder head 3. The space section 31 is registered in position so as to be vertically aligned with the space section 21 for the chain 19 provided in the cylinder block 2. This configuration allows the chain 19 to pass from the crankshaft 10 to an upper portion of the cylinder head 3 without interference.

Figure 5B:
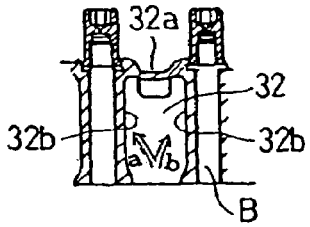
FIG. 5*b* is a sectional view of the cylinder block of the internal combustion engine of the present invention taken along line C—C of FIG. 5*a*.

A depressed portion 32 is provided at a portion of the cylinder head 3 forwardly (on the exhaust side) of the longitudinal central portion 30 in the top plan describe hereinabove. That is, depressed portion 32 is positioned at a front portion of the cylinder head 3 on a line that is coaxial with the center line in the longitudinal direction of the space section 31 for the chain 19. The depressed portion 32 is depressed toward the rear from a front portion of the cylinder head 3 such that it reaches a position adjacent a wall portion forwardly of the space section 31 for the chain 19. The depressed portion 32 has a top wall 32*a* which is slightly depressed at an upper portion thereof between two stud bolts B, B as seen in FIG. 5*b*.

A portion above the top wall 32*a* of the depressed portion 32 is formed as a concave structural portion. A chain 36 extends in the forward and backward direction of the vehicle and connects two camshafts 33, 34 in a driving relationship. The chain 36 passes through the concave structural portion. This portion is covered with a chain cover 41 which extends substantially across a central portion 40 of the cylinder head cover 4, which is hereinafter described, in its widthwise direction.

Figure 5C:
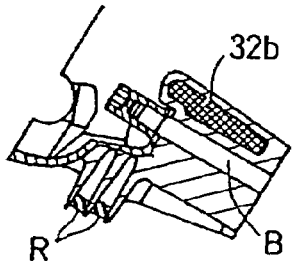
FIG. 5*c* is a sectional view of the cylinder block of the internal combustion engine of the present invention taken along line D—D of FIG. 5*a*.
Figure 5D:
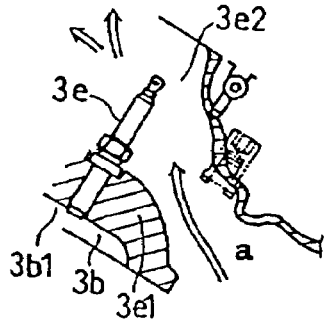
FIG. 5*d* is a sectional view of the cylinder block of the internal combustion engine of the present invention taken along line E—E of FIG. 5*a*.

Openings 32*b* are provided at the opposite left and right side portions of a lower wall of the top wall 32*a* of the depressed portion 32 as seen in FIG. 5*c*. The left and right openings 32*b* communicate with lower portion openings 42*c*, 43*c* (refer to FIG. 12) of concave portions 42*b*, 43*b* of the cylinder head cover 4 through communication with concave spaces 3*e*2. The concave spaces 3*e*2 are located at upper portions of seat portions 3*e*1 of the ignition plugs 3*e* disposed on the left and right across the longitudinal central portion 30 of the cylinder head 3 as seen in FIG. 5*d*.

Figure 12:
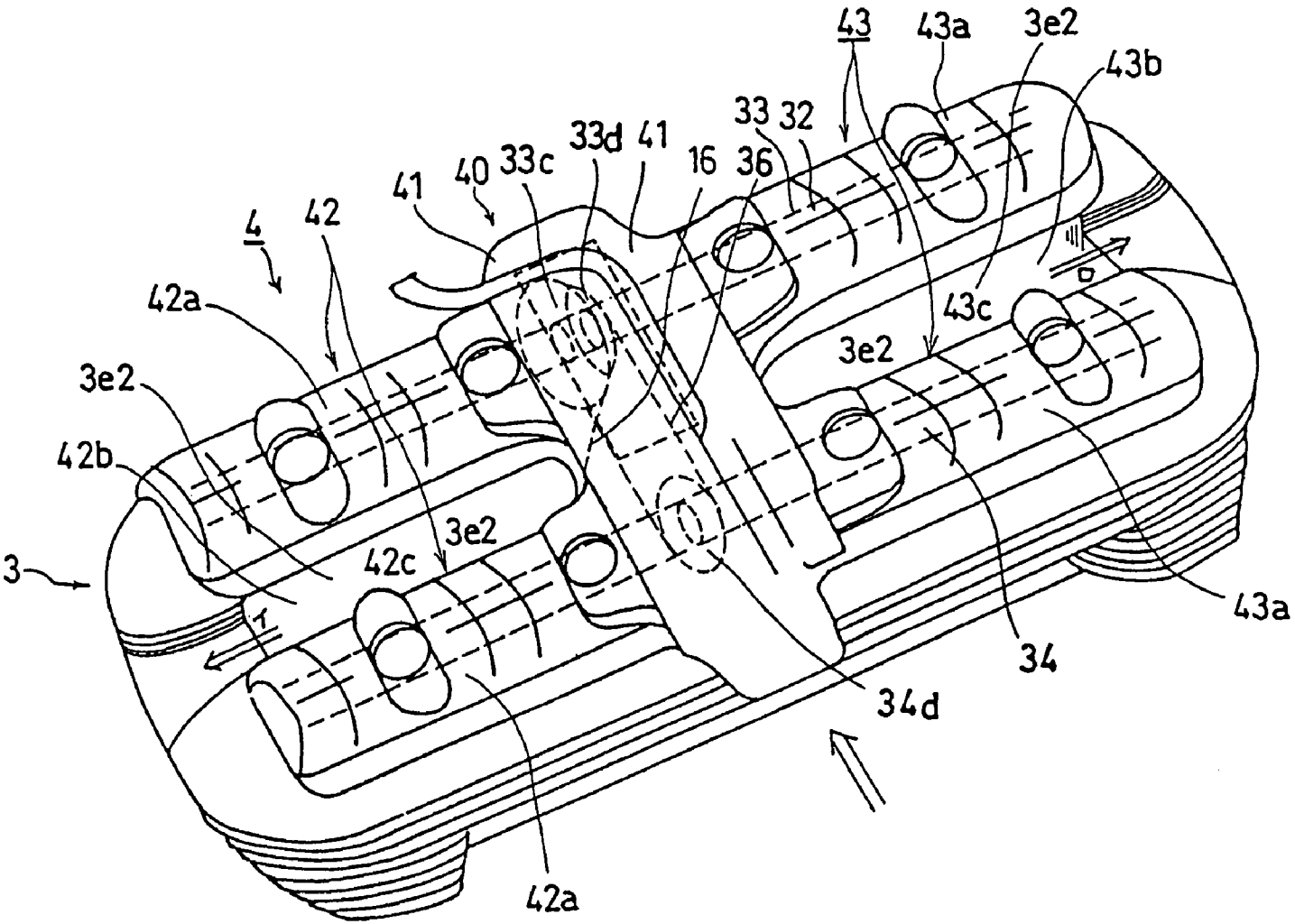
FIG. 12 is a top perspective view of the a cylinder head cover of the present invention showing the substantially H-shaped outer profile, wherein the air flow path therethrough is shown using open arrows.
Figure 13A:
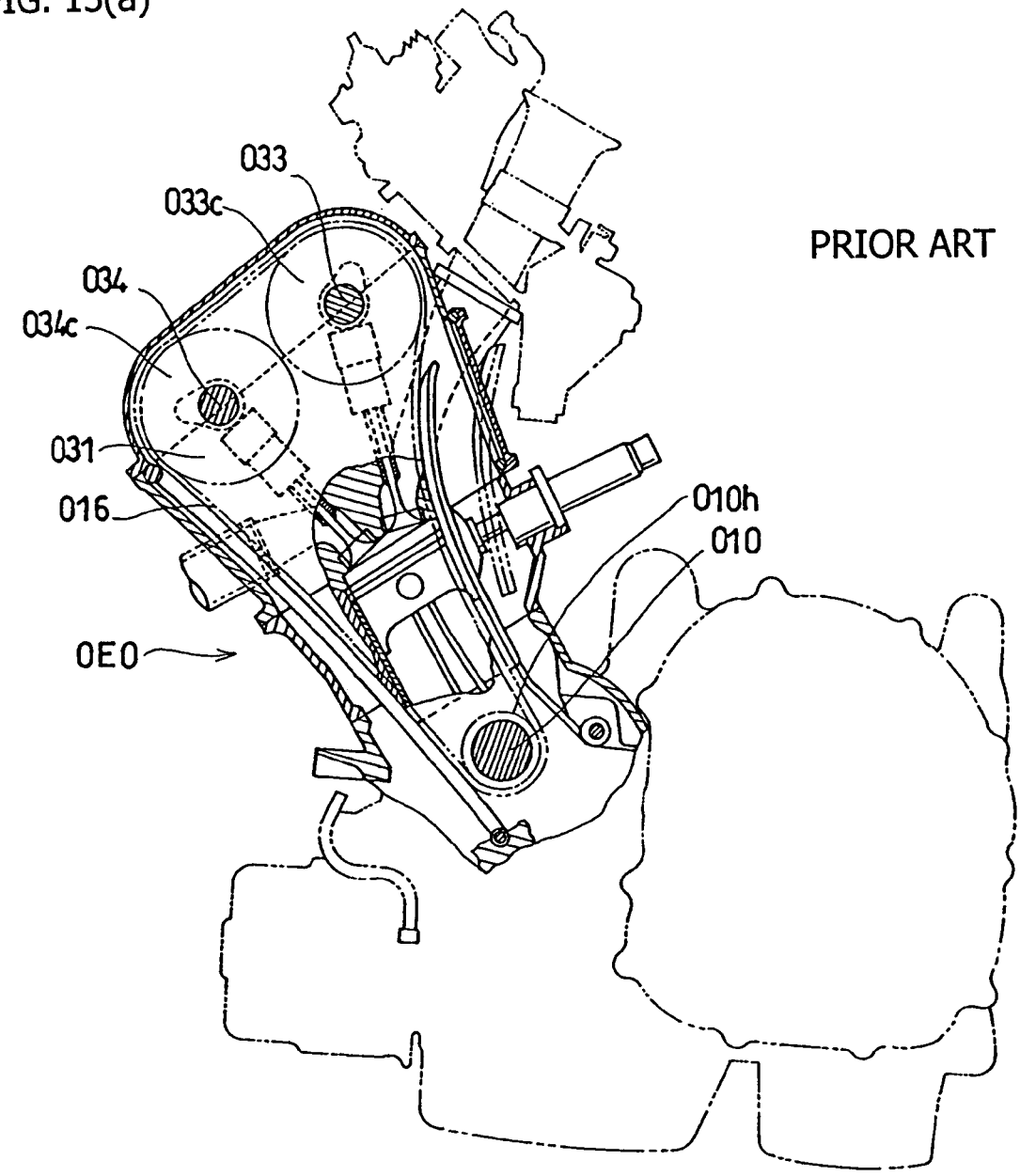
FIG. 13*a* is a side elevational sectional view of the cylinder section of a prior art internal combustion engine showing both camshafts of a DOHC driven by a single chain.
Figure 13B:
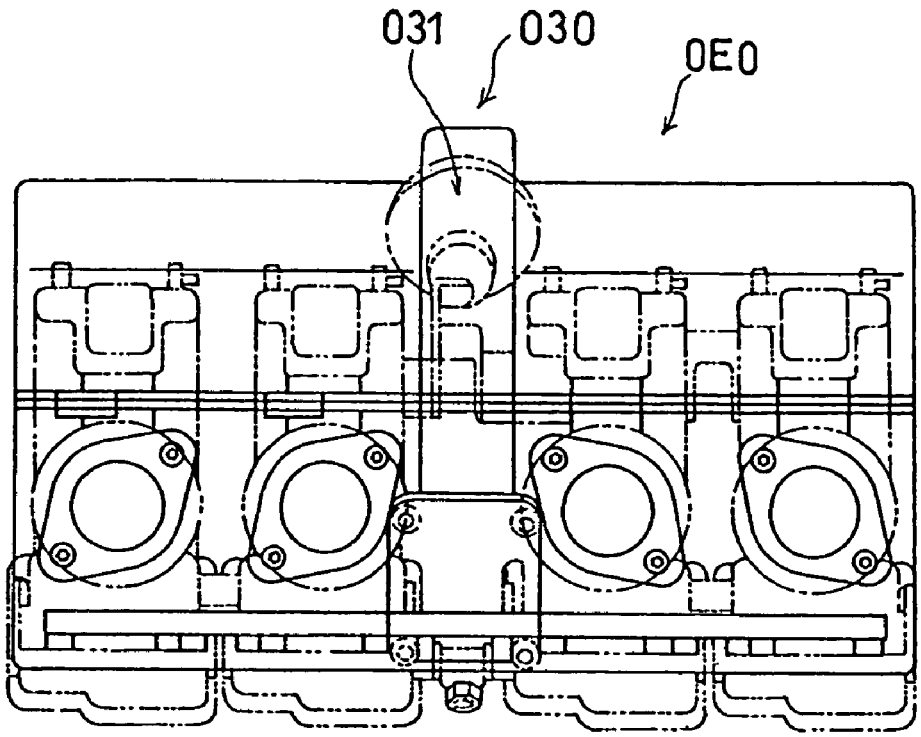
FIG. 13*b* is a plan view as viewed from above in FIG. 13*a* showing the cylinder section of the prior art internal combustion engine.
Figure 14A:
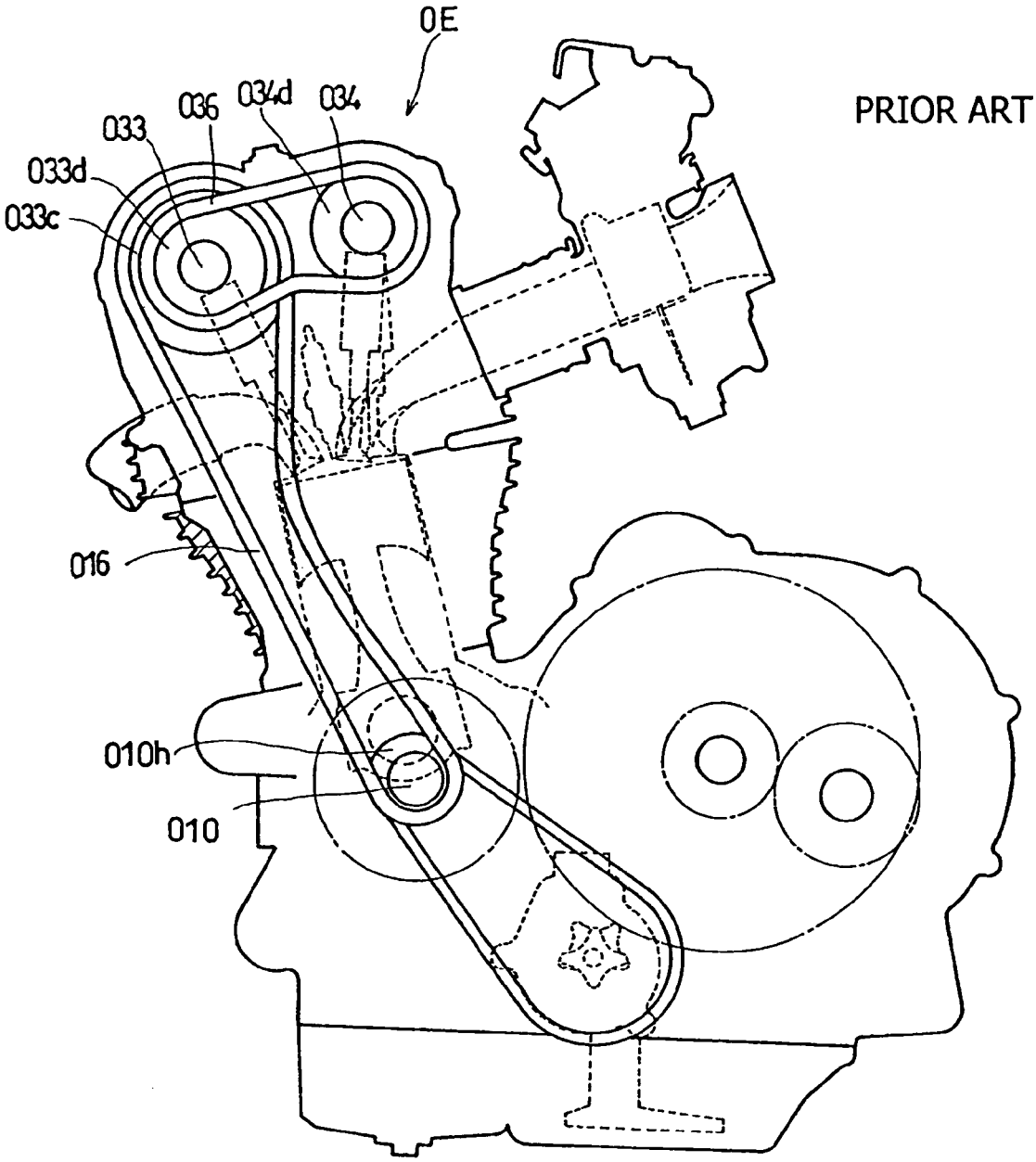
FIG. 14*a* is a side elevational sectional view of the cylinder section of a second prior art internal combustion engine showing a first camshaft of a DOHC driven by a first chain, and a second camshaft driven by the first camshaft using a second chain.
Figure 14B:
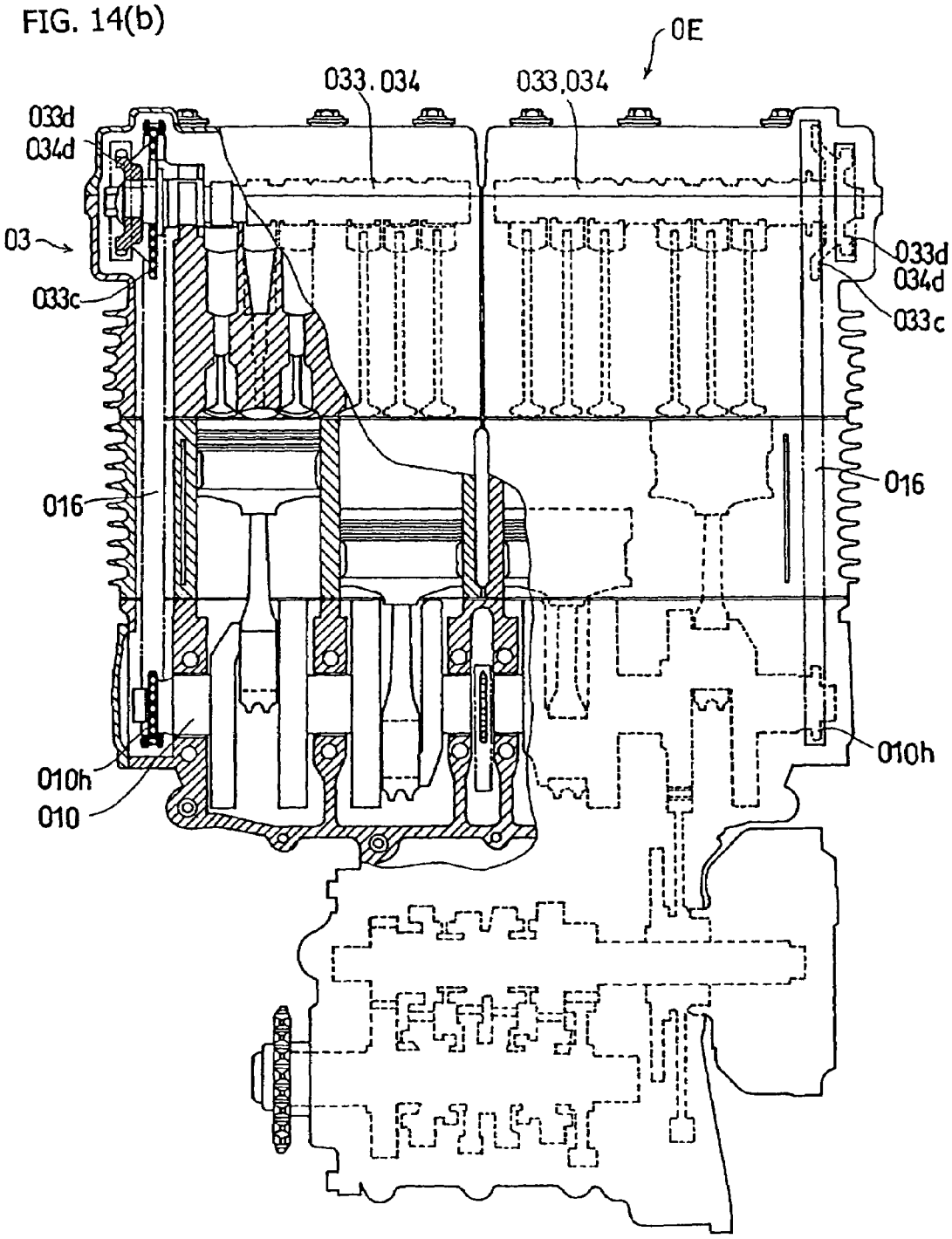
FIG. 14*b* a front elevational view partly in section in FIG. 14*a* showing a structure of the cylinder section of the conventional internal combustion engine.

The concave spaces 3*e*2 are located at the upper portions of the seat portions 3*e*1 of the ignition plugs 3*e* and are formed as groove-like portions which open upwardly and extend from the longitudinal central portion 30 toward both the left and right in the longitudinal direction of the cylinder head 3, substantially on opposed sides of the longitudinal central portion 30 of the cylinder head 3 as can be recognized from FIGS. 5, 7, 12 and others. The individual groove-like portions 3*e*2, 3*e*2, extending leftwardly and rightwardly, extend through upper portions of the seat portions 3*e*1 of the two ignition plugs 3*e* juxtaposed on a straight line until the outer left and right portions project from the left and right end portions in the longitudinal direction of the cylinder head 3.

The depressed portion 32, and the openings 32*b* on the left and right of the depressed portion 32, act very effectively to introduce running wind into the cylinder head 3 when the vehicle 50 travels and contribute to cooling of the cylinder head 3 and the cylinder block 2. The cooling action by introduction of the running wind is hereinafter described.

As can be recognized from reference to FIGS. 1, 2 and so forth, the valve system includes two camshafts 33, 34 each including a plurality of cams 33*a*, 34*a*, and a driving mechanism for driving the camshafts 33, 34. The valve system further includes a valve operating mechanism including lifters 3*k*2, 3*m*2 for the intake and exhaust valves 3*k*, 3*m* for contacting with the cams 33*a*, 34*a* to push valve stems 3*k*1, 3*m*1 of the cams 33*a*, 34*a*, respectively, and so forth. The camshafts 33, 34 extend along the longitudinal direction of the cylinder head 3 perpendicular to the advancing direction of the vehicle 50 and are disposed for rotation in parallel to each other through bearing portions and in a positional relationship wherein they are positioned forwardly and rearwardly in the advancing direction of the vehicle 50.

The cams 33*a*, 34*a* (refer to FIG. 2) provided on the camshafts 33, 34, respectively, are contacted by the valve lifters 3*k*2, 3*m*2 to open and close the intake and exhaust valves 3*k*, 3*m*. Accordingly, the cams 33*a*, 34*a* are disposed on the camshafts 33, 34 corresponding to upper ends of the valve stems 3*k*1, 3*m*1 of the intake and exhaust valves 3*k*, 3*m*, respectively,. In the present embodiment, the opening/closing cams 33*a* for the intake valves 3*k* are disposed on the camshaft 33 on the rear side of the vehicle 50.

Meanwhile, the opening/closing cams 34*a* for the exhaust valves 3*m* are disposed on the camshaft 34 on the front side of the vehicle 50. Since a so-called four-valve system is used wherein the two intake valves 3*k* and the two exhaust valves 3*m* are disposed corresponding to each of the combustion chambers 3*a* to 3*d* as seen in FIG. 2, the eight cams 33*a*, 34*a* are disposed on the two camshafts 33, 34, respectively.

Two sprocket wheels 33*c*, 33*d*, having different diameters from each other, are provided at a substantially central portion 33*b* in the longitudinal direction on the camshaft 33 positioned on the rear side of the vehicle 50. The sprocket wheel 33*c* of the large diameter corresponds to the sprocket wheel 10*h* of the small diameter provided at a substantially central portion in the longitudinal direction of the crankshaft 10, and the large diameter sprocket wheel 33*c* of the camshaft 33 has a size just equal to twice the diameter of the small diameter sprocket wheel 10*h* of the crankshaft 10.

The camshaft driving chain 19 extends between the sprocket wheels 10*h*, 33*c* so that rotational driving force of the crankshaft 10 may be transmitted to the camshaft 33. The diameters of the two sprocket wheels 10*h*, 33*c* are set such that the speed of rotation of the camshaft 33 is just equal to ½ the speed of rotation of the crankshaft 10.

Further, as can be seen apparently from reference to FIGS. 1 and 2, the sprocket wheel 33*d* of the small diameter provided at the substantially central portion 33*b* in the longitudinal direction of the rear side camshaft 33 is a sprocket wheel used for driving by the chain 36 to transmit rotational driving force of the rear side camshaft 33 to the camshaft 34. Accordingly, a sprocket wheel 34*d* similar to and corresponding to the sprocket wheel 33*d* of the rear side camshaft 33 is provided on the front side camshaft 34, and the two sprocket wheels 33*d*, 34*d* have diameters equal to each other but smaller than that of the sprocket wheel 33*c* of the rear side camshaft 33.

The driving chain 36, that is, the driving chain 36 between the camshafts, extends between the two sprocket wheels 33*d*, 34*d* so that the front and rear camshafts 33, 34 rotate at speeds equal to each other through the chain 36. Accordingly, upon operation of the engine the rotational driving force of the crankshaft 10 is transmitted at a speed of rotation reduced to ½ to the camshafts 33, 34 through the two driving chains 16, 36. The intake valves 3*k* are operated to open and close by pushing of the valve lifters 3*k*2 of the opening/closing cams 33*a* by the rotation of the rear side camshaft 33 while the exhaust valves 3*m* are operated to open and close by pushing of the valve lifters 3*m*2 of the opening/closing cams 34*a* by the rotation of the front side camshaft 34 as described hereinabove.

A chain tensioner 19A, serving as a chain tension adjustment mechanism for smoothing chain motion transmission, is provided for the chain 19. The chain tensioner 19A transmits driving force between the crankshaft 10 and the camshafts 33, 34 described hereinabove as seen in FIG. 1. A tensioner slipper 19A1 is attached at an end portion thereof (lower end portion in the figure) for pivotal motion at a structural portion of a rear portion of the engine and is pressed against the chain 19 from the rear outer side in the figure by the tensioner 19A. The pressing force of the tensioner slipper 19A1 against the chain 19 is suitably adjusted by the tensioner 19A to adjust the tension of the chain 19.

Further, a chain tensioner 36A, serving as a chain tension adjustment mechanism, is provided for the driving chain 36 between the camshafts 33, 34. A tensioner slipper 36A1 is attached at an end portion thereof for pivotal motion on the cylinder head cover 4 and is pressed against the chain 36 from the upper outer side in the figure by the tensioner 36A.

Figure 8:
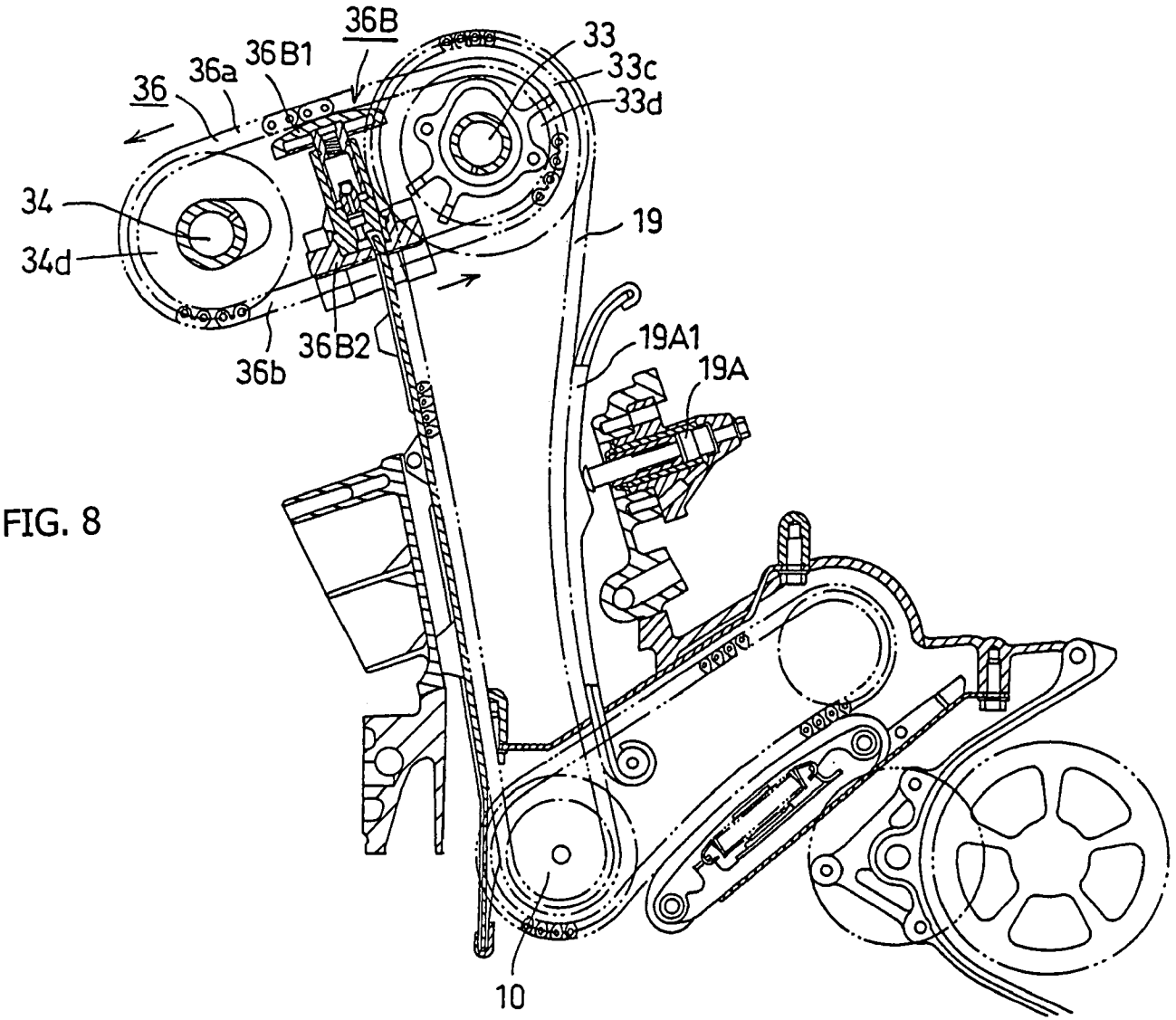
FIG. 8 is an isolated side view of the camshaft driving mechanism showing an embodiment wherein an inventive chain tensioner is used in the present invention.
Figure 9B:
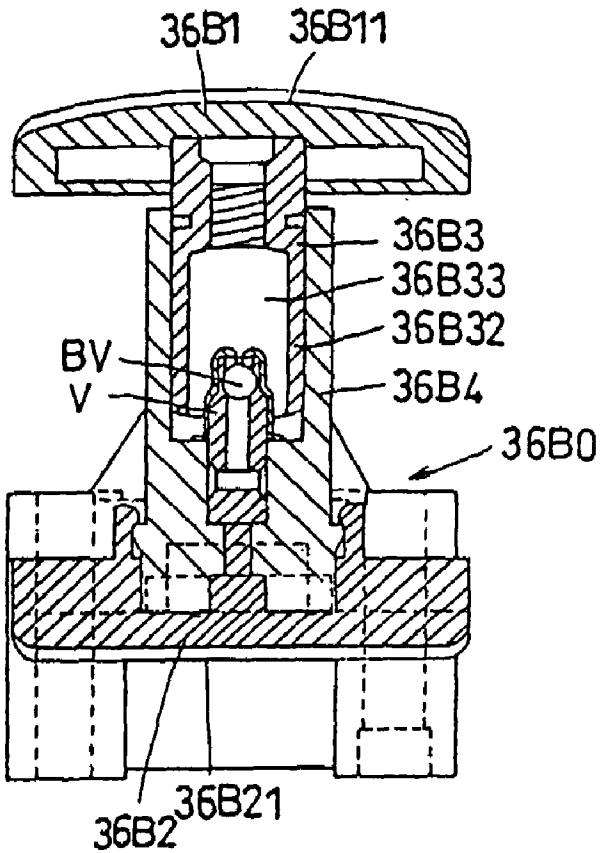
FIG. 9*b* is a detail sectional view of the body structure of the chain tensioner of FIG. 8 taken along line F—F of FIG. 9*a*.
Figure 9A:
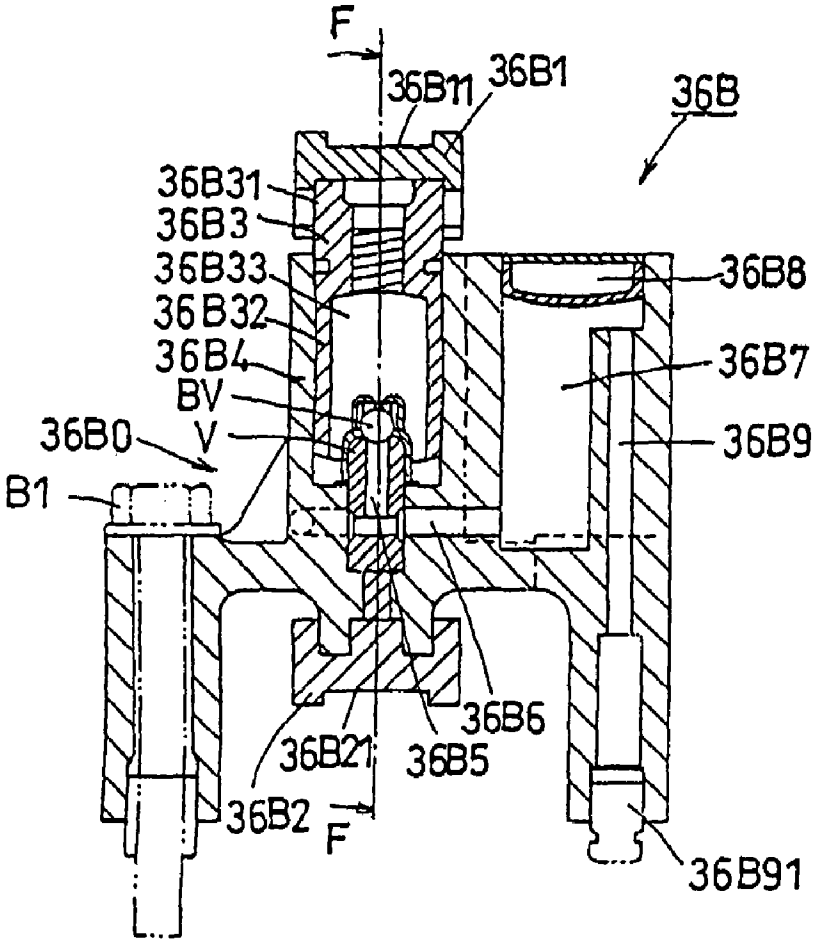
FIG. 9*a* is a front elevational detail sectional view of the body structure of the chain tensioner of FIG. 8 showing the lubrication passageways formed therein.
Figure 11:
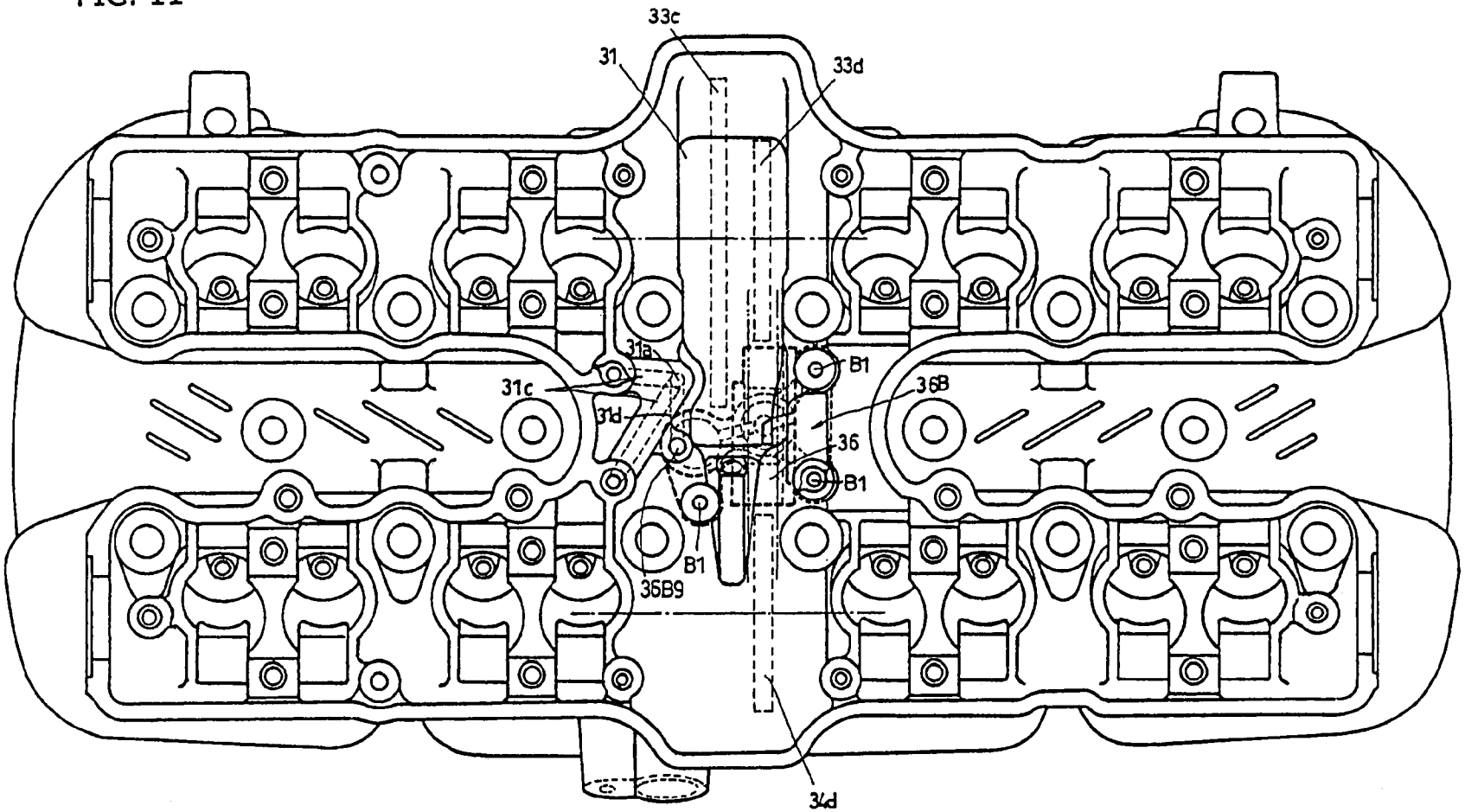
FIG. 11 is a top plan view of the cylinder head shown in FIG. 10.

An alternative embodiment tensioner 36B, shown in FIGS. 8, 9, 11, can be used in place of the chain tensioner 36A. The tensioner 36B is of the type wherein it strains the chain 36 from the inner side of the chain 36. That is, the tensioner 36B strains the chain 36 from between upper and lower pass portions 36*a*, 36*b* of the camshaft driving chain 36 such that the chain 36 protrudes outwardly in the upward and downward direction in FIG. 8. To this end, the tensioner 36B includes an upper guide 36B1 for guiding the upper pass portion 36*a* in pass in circulation of the chain 36 wherein the relative distance between the upper and lower pass portions 36*a*, 36*b* is adjusted in the upward and downward direction, and a lower guide 36B2 for guiding the lower pass portion 36*b* in path in circulation of the chain 36.

The upper and lower guides 36B1, 36B2 have slot-like chain guide portions 36B11, 36B21 elongated in the feeding direction in circulation of the chain 36, respectively, as seen in FIG. 9. The upper guide 36B1 is coupled to a piston 36B3 while the lower guide 36B2 is coupled to a base portion 36B0 of a cylinder element 36B4 side.

The cylinder element 36B4 of the tensioner 36B is formed integrally with a base portion 36B0 of the tensioner 36B used for attachment to the cylinder head 3. The base portion 36B0 is secured to the cylinder head 3, shown in a top plan of FIG. 11 (indicated by broken lines), by bolts B1 at three locations to position the cylinder element 36B4 with respect to the chain 36. The piston 36B3 is disposed for sliding movement in the cylinder element 36B4. The piston 36B3 is secured by the upper guide 36B1 screwed in an increased thickness head portion 36B31 at the upper portion of the piston 36B3 as described hereinabove.

The piston 36B3 has a skirt portion 36B32 at a lower portion thereof. The inner side of the cylinder element 36B4 surrounds the skirt portion 36B32, which forms a hollow portion 36B33. A supply valve apparatus V is disposed at a lower portion of the cylinder element 36B4 such that a ball valve BV thereof is positioned in the hollow portion 36B33. A supplying oil path 36B5 extends in the direction of the cylinder axial line and communicates with the ball valve BV of the supply valve apparatus V. The supplying oil path 36B5 communicates at a base portion thereof with an end of a supplying oil path 36B6, which extends in a perpendicular direction to the supplying oil path 36B5, through an annular oil path. The supplying oil path 36B6 communicates at the other end thereof with a lower portion of a vertically elongated oil reservoir chamber 36B7.

A flexible chamber 36B8 of a variable volume filled with gas such as the air for adjusting a pressure variation of pressure oil is provided at an upper portion of the vertically elongated oil reservoir chamber 36B7. A supplying oil path 36B9 to the oil reservoir chamber 36B7 communicates through a branch oil path with a pressure oil supplying oil path 31*a* formed around the space section 31 for the camshaft chain 36 of the cylinder head 3 shown in FIGS. 10, 11. This pressure oil supplying oil path 31*a* is a pressure oil supplying oil path to the valve systems for the camshafts and so forth.

Figure 10:
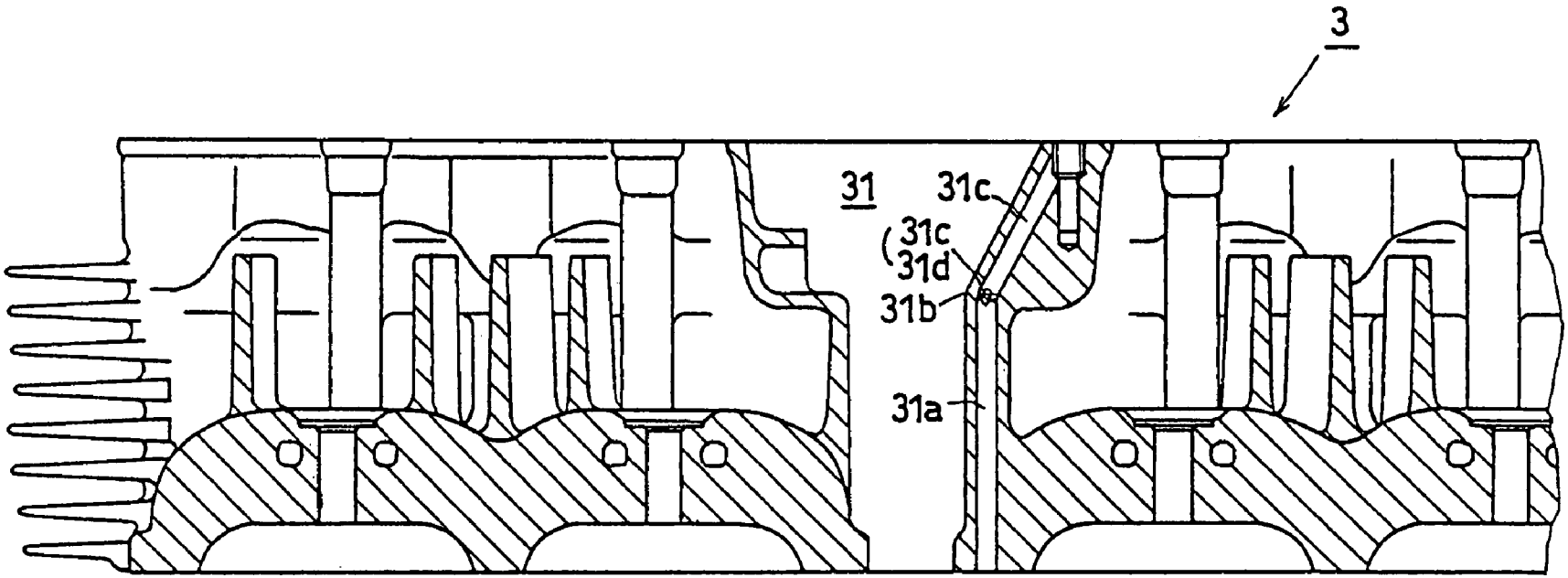
FIG. 10 is a sectional view of a cylinder head having a supplying oil path corresponding to the embodiment of the present invention shown in FIG. 8.

The pressure oil supplying oil path 31*a* extends from a lower portion to an upper portion of the cylinder head 3 as seen in FIG. 10. The supplying oil path 31*a* communicates at a lower opening thereof with an oil path which passes in the cylinder block 2 and is open at an upper portion of the cylinder block 2. The pressure oil supplying oil path 31*a* has, at a position comparatively near to the upper portion of the cylinder head 3, a branching portion 31*b* at which it is branched into two oil paths (only one is shown in FIG. 10) 31*c*, 31*c* and a thin, horizontal branch oil path 31*d* (refer to FIG. 11). The oil paths 31*c*, 31*c* are directed obliquely upwardly to supply pressure oil into the two front and rear camshafts 33, 34 disposed in pair at an upper portion of the cylinder head 3.

The thin, horizontal branch oil path 31*d* branching at the branching portion 31*b* is communicated at an end portion thereof with an opening 39B91 at a lower portion in the figure of the supplying oil path 36B9 of the tensioner 36B described above (refer to FIG. 11). Accordingly, pressure oil is supplied from the pressure oil supplying oil path 31*a* to the tensioner 36B through the thin, horizontal branch oil path 31*d*, and this supply of pressure oil achieves reduction in length of the supplying oil path for the tensioner 36B. It is to be noted that reference characters 33*c*, 33*d*, 34*d* in FIG. 11 denote each a chain driving sprocket wheel. Further, a chain of the bushing type is used for the driving chains 19, 36.

The piston 36B3 of the tensioner 36B is slidably movable within the cylinder element 36B4 as described hereinabove. Where the cylinder element 36B4 is filled with pressure oil introduced therein through the supplying oil path when the ball valve BV of the supply valve apparatus V is open, the piston 36B3 can bear a load exerted by the tension of the chain 36 on the upper guide 36B1 coupled to an upper portion of the piston 36B3 by means of the pressure oil in the cylinder element 36B4. Consequently, deflection of the chain 36 is effectively suppressed.

An upper portion of the cylinder head 3 is covered with the cylinder head cover 4. As shown in the perspective view of FIG. 12, the cylinder head cover 4 has a generally substantially rectangular elongated structure wherein it extends in a direction perpendicular to the forward and backward direction of the vehicle 50 similarly to the cylinder head 3. While the cover 4 covers the two camshafts 33, 34 indicated by broken lines in FIG. 12 substantially fully from above, portions of the cover 4 corresponding to the groove-like portions formed from the concave spaces 3*e*2 at an upper portion of the mounting seat portions 3*e*1 for the ignition plugs 3*e* are formed as openings from which the cover 4 is removed and do not cover the groove-like portions.

Further, the space section 31 for the chain 19, which is provided at the central portion 40 of the cylinder head cover 4 and substantially accommodates the sprocket wheels 33*c*, 33*d* attached to the camshaft 33, and the upper pass portion 36*a* of the camshaft driving chain 36 extending between the sprocket wheels 33*d*, 34*d* for driving the camshaft 34, are covered with the chain cover 41. Chain cover 41 is a separate structure from the cylinder head cover 4, and extends across the central portion 40 of the cylinder head cover 4 in the widthwise direction.

Accordingly, the cylinder head cover 4 particularly has a substantially H-shaped outer profile in a plan as seen in FIG. 12. Pairs of cover portions 42, 42, 43, 43 extending from the opposite sides of the chain cover 41 of the longitudinal central portion 40 of the cylinder head cover 4 form two mountain portions 42*a*, 42*a*, 43*a*, 43*a* which protrude upwardly and extend in the longitudinal direction so as to just cover the camshafts 33, 34. Meanwhile, portions of the cover portions 42, 42, 43, 43 between the mountain portions 42*a*, 42*a* and between the mountain portions 43*a*, 43*a* form valley portions extending in the longitudinal direction. The concave portions 42*b*, 43*b* which form the valley portions are formed, at bottom portions thereof, as the lower portion openings 42*c*, 43*c* at which the cylinder head cover 4 is cut away. The lower portion openings 42*c*, 43*c* are opposed so as to be exposed to the grooved portions formed from the concave spaces 3*e*2 at upper portions of the mounting seat portions 3*e*1 for the ignition plugs 3*e*.

When the cylinder head cover 4 is mounted on the cylinder head 3, the elongated lower portion openings 42*c*, 43*c* of the concave portions 42*b*, 43*b* of the cylinder head cover 4 which are paired with each other communicate with the opposed side openings 32*b* of the depressed portion 32 which is a cooling space formed forwardly of the cylinder head 3 described hereinabove. The communication is achieved through the concave spaces 3*e*2 at upper portions of the seat portions 3*e*1 for the ignition plugs 3*e*, that is, through the groove-like portions.

Here, operation of a flow of running wind, generated by the forward motion of the vehicle, is described.

When the vehicle 50 travels, running wind flows into the depressed portion 32 at the front central portion of the cylinder head 3 to cool the circumferential wall of the depressed portion 32 (refer to arrow marks a, b of FIGS. 5*a* and 5*b*). The introduced cooling wind is distributed both toward the left and right sides along the longitudinal axis of the cylinder head, and flows in from the opposed left and right side openings 32*b* of the depressed portion 32 (refer to arrow marks a, b of FIGS. 5*a* and 5*b* to 5*d*). The flows of the cooling wind flow along the upper portion concave spaces 3*e*2 of the mounting seat portions 3*e*1 for the ignition plugs 3*e* or pass the concave spaces 3*e*2 and then flow along the elongated bottom portion openings 42*c*, 43*c* of the concave portions 42*b*, 43*b* paired with each other between the mountain portions 42*a*, 42*a* and between the mountain portions 43*a*, 43*a* of the cylinder head cover 4.

Then, the flows of the cooling wind flow out from the opposite end portions (left and right ends) in the longitudinal direction of the cylinder head 3 and form flows which go around to the opposite side portions and rear portions of the cylinder head 3 and the cylinder block 2.

Since the flows of the cooling wind cool the circumferential wall of the depressed portion 32, cooling on the exhaust side is performed efficiently. Further, since the depressed portion 32 is comparatively deep and extends down to a position proximate to the space section 31 for the chain 19, portions around intermediate portions of the cylinder block 2 disposed in the proximity of the space section 31 which correspond to upper portions of the cylinder bores 2*b*, 2*c* can be cooled. Further, the flows of the cooling wind cool the seat portions 3*e*1 and the circumferential wall portions of the upper portion concave spaces 3*e*2 above the seat portions 3*e*1 and efficiently cool the upper portion of the cylinder head 3. Furthermore, the flows of the cooling wind also efficiently cool the opposite side portions and the rear portions of the cylinder head 3 and the cylinder block 2.

In this manner, the running wind is introduced efficiently into or around the cylinder head 3 through the depressed portion 32 which forms a cooling space from forwardly of the cylinder head 3. The introduced wind very efficiently cools the circumferential wall of the depressed portion 32, the seat portions 3*e*1 for the ignition plugs 3*e*, the circumferential wall portions of the concave spaces 3*e*2 at upper portions of the seat portions 3*e*1 and so forth. Further the wind efficiently cools also various places such as the side portions and the rear portion of the cylinder head 3. Therefore, the cooling effect is very great.

Further, in association with the above described cooling effect resulting from the shape of the circumferential wall of the depressed portion 32 and the cooling of the mounting seat portions 3*e*1 for the ignition plugs 3*e* and portions around the mounting seat portions 3*e*1, cooling of the cylinder bores 2*b*, 2*c* adjacent the space section 21 can also be performed efficiently.

A cylinder structure for an internal combustion engine of the present invention has been presented which can be applied not only restrictively as a cylinder structure for an air-cooled internal combustion engine for a motorcycle but also as a cylinder structure for an air-cooled internal combustion engine for any other vehicle.

While a working example of the present invention has been described above, the present invention is not limited to the working example described above, but various design alterations may be carried out without departing from the present invention as set forth in the claims.

We claim:

1. An air-cooled internal combustion engine for a vehicle, said engine comprising:

a cylinder block having a plurality of cylinder bores disposed in parallel to each other, a cylinder head secured to an upper portion of said cylinder block, a crankshaft, two camshafts disposed in a parallel, juxtaposed relationship to each other so as to extend perpendicularly to a forward and backward direction of the vehicle at an upper portion of said cylinder head and positioned on front and rear sides of the engine relative to each other, a camshaft driving mechanism for transmitting rotational driving force of the crankshaft to said camshafts, and a substantially H-shaped cylinder head cover attached to said cylinder head and defining an air flow passage therein which extends between said camshafts, wherein a cooling space into which running wind can be introduced is formed below that one of said camshafts which is positioned on the front side of the engine, and wherein the cylinder head cover has an opening formed therein which interconnects said cooling space and said air flow passage.

2. An engine according to claim 1 wherein said camshaft driving mechanism for transmitting the rotational driving force of said crankshaft to said camshafts includes a first camshaft driving device, disposed between said cylinder bores of said cylinder block, for transmitting the rotational driving force of said crankshaft to that one of said camshafts which is on the rear side of said vehicle, and a second camshaft driving device for transmitting the rotational driving force transmitted to the rear side camshaft further to the front side camshaft, wherein said cooling space into which the running wind can be introduced is formed forwardly of said first camshaft driving device and below said second camshaft driving device.

3. An engine according to claim 2 wherein an inputting portion of said first camshaft driving device for the rear side camshaft is formed with a diameter greater than that of an outputting portion of said second camshaft driving device.

4. An engine according to claim 2 wherein said second camshaft driving device includes a chain, the engine further comprises a tensioner to maintain tension of said chain, and said tensioner applies tension outwardly from a location between portions of said chain.

5. An engine according to claim 2 wherein an inputting portion of said first camshaft driving device for the rear side camshaft is formed with a diameter greater than that of an outputting portion of said second camshaft driving device.

6. An engine according to claim 1 wherein the transmission of the rotational driving force of said camshaft driving mechanism is performed using a chain.

7. An engine according to claim 1, wherein said internal combustion engine is a four-cylinder engine having four cylinder bores extending in parallel to each other, and said camshaft driving mechanism is disposed between the second one and the third one of said cylinder bores.

8. The air-cooled internal combustion engine of claim 1, wherein the cooling space is configured to branch incoming air into two separate channels, wherein the cylinder head cover defines two air flow passages therein between the camshafts, and wherein during forward movement of the vehicle, air from the cooling space is directed into the two channels of the cooling space, and is then forced in opposite directions through the air flow passages of the cylinder head cover.

9. An air-cooled internal combustion engine for a vehicle, comprising:

a cylinder block having a plurality of cylinder bores disposed in parallel to each other, a cylinder head secured to an upper portion of said cylinder block, a crankshaft, two camshafts disposed in a parallel, juxtaposed relationship to each other so as to extend perpendicularly to a forward and backward direction of the vehicle at an upper portion of said cylinder head and positioned on front and rear sides of the engine relative to each other, a camshaft driving mechanism for transmitting rotational driving force of the crankshaft to said camshafts, and a cylinder head cover attached to said cylinder head and having a concave portion formed in a concave shape between said camshafts, and the concave portion comprises an opening at a lower portion thereof;

wherein a cooling space into which running wind can be introduced is formed below that one of said camshafts which is positioned on the front side of the engine; and the opening formed in the concave portion of the cylinder head cover communicates with said cooling space.

10. An air-cooled internal combustion engine comprising:

a cylinder block having a plurality of cylinder bores disposed in parallel to each other, a cylinder head secured to an upper portion of said cylinder block, a crankshaft, two camshafts disposed in a parallel, juxtaposed relationship to each other so as to extend perpendicularly to a forward and backward direction of the engine at an upper portion of said cylinder head and positioned on front and rear sides of the engine relative to each other, and a camshaft driving mechanism for transmitting rotational driving force of the crankshaft to said camshafts, said camshaft driving mechanism includes a first camshaft driving device, disposed between said cylinder bores of said cylinder block, for transmitting the rotational driving force of said crankshaft to that one of said camshafts which is on the rear side of said vehicle, and a second camshaft driving device for transmitting the rotational driving force transmitted to the rear side camshaft further to the front side camshaft, and a cooling space into which a flow of air can be introduced is formed below that one of said camshafts which is positioned on the front side of the engine, forwardly of said first camshaft driving device and below said second camshaft driving device.

11. The air-cooled internal combustion engine of claim 10 wherein each of the first camshaft driving device and the second camshaft driving device includes a chain, and said engine further comprises a tensioner in order to maintain tension of said chain of said second camshaft driving device, and said tensioner applies tension outwardly from a location between portions of said chain.

12. The air-cooled internal combustion engine of claim 10 wherein said internal combustion engine is a four-cylinder engine having the four cylinder bores extending in parallel to each other, and said camshaft driving mechanism is disposed so as to lie between a first two of the cylinder bores and a second two of the cylinder bores.

13. The air-cooled internal combustion engine of claim 10 farther comprising a generally H-shaped cylinder head cover, the cylinder head cover is attached to said cylinder head and has a concave portion formed in a concave shape between said camshafts, and the concave portion comprises an opening at a lower portion thereof and communicates with said cooling space through the opening.

14. The air-cooled internal combustion engine of claim 10 wherein an inputting portion of said first camshaft driving device for the rear side camshaft is formed with a diameter greater than that of an outputting portion of said second camshaft driving device.

15. The air-cooled internal combustion engine of claim 10 wherein each of the first camshaft driving device and the second camshaft driving device includes a chain, the cylinder head comprises a longitudinal centerline that intersects an axial centerline of each cylinder bore, the cylinder head further comprises an elongate vacancy extending vertically therethrough which receives the chain of the first camshaft driving device, and the elongate vacancy is positioned at the midpoint of the cylinder head in the longitudinal direction such that it is positioned substantially rearward of the longitudinal centerline.

16. The air-cooled internal combustion engine of claim 15 wherein the cooling space extends inward from the front of the engine at a midpoint of the cylinder head in the longitudinal direction toward the rear of the engine to a location adjacent a front wall of the elongate vacancy.

17. The air-cooled internal combustion engine of claim 15 further comprising a substantially H-shaped cylinder head cover, and the cooling space cooperates with the cylinder head cover to direct the introduced flow of air to intermediate portions of the cylinder bores.

18. An air-cooled internal combustion engine comprising:

a cylinder block having a plurality of cylinder bores disposed in parallel to each other, a cylinder head secured to an upper portion of said cylinder block and provided with an exterior shape which promotes air flow to intermediate portions of the plurality of cylinder bores, a crankshaft, two camshafts disposed in a parallel, juxtaposed relationship to each other so as to extend perpendicularly to a forward and backward direction of the engine at an upper portion of said cylinder head and positioned on front and rear sides of the engine relative to each other, a camshaft driving mechanism for transmitting rotational driving force of the crankshaft to said camshafts, the camshaft driving mechanism including a first camshaft driving device, disposed between said cylinder bores of said cylinder block, for transmitting the rotational driving force of said crankshaft to that one of said camshafts which is on the rear side of said vehicle, and a second camshaft driving device for transmitting the rotational driving force transmitted to the rear side camshaft further to the front side camshaft, each of the first camshaft driving device and the second camshaft driving device includes a chain, and a tensioner to maintain tension of said chain of said second camshaft driving device, said tensioner applies tension outwardly from a location between portions of said chain of said second camshaft driving mechanism;

wherein the cylinder head comprises a cooling space into which the flow of air can be introduced to the intermediate portions of the cylinder bores, and wherein the cooling space is formed below that one of said camshafts which is positioned on the front side of the engine, forwardly of said first camshaft driving device and below said second camshaft driving device.

19. The air cooled internal combustion engine of claim 18 further comprising a substantially H-shaped cylinder head cover attached to said cylinder head, the cylinder head cover has a concave portion formed in a concave shape between said camshafts, the concave portion comprises an opening at a lower portion thereof and communicates with said cooling space through the opening.

20. The air-cooled internal combustion engine of claim 18 wherein the tensioner comprises an upper guide for guiding an upper portion of the chain of said second camshaft driving device and a lower guide for guiding a lower portion of the chain of said second camshaft driving device, the upper guide and the lower guide extend from opposed surfaces of the tensioner, and a relative distance between the upper guide and the lower guide is adjustable.

* * * * *